US006033504A

United States Patent [19]

Judkins

[11] Patent Number: 6,033,504

[45] Date of Patent: Mar. 7, 2000

[54] MATERIAL FOR VENETIAN TYPE BLINDS

[76] Inventor: Ren Judkins, 46 Newgate Rd., Pittsburgh, Pa. 15202

[21] Appl. No.: 09/141,689

[22] Filed: Aug. 28, 1998

Related U.S. Application Data

[60] Division of application No. 08/838,007, Apr. 14, 1997, which is a continuation-in-part of application No. 08/293,751, Aug. 22, 1994, Pat. No. 5,620,035, which is a continuation-in-part of application No. 07/952,645, Sep. 28, 1992, Pat. No. 5,339,882, which is a continuation-in-part of application No. 08/661,192, Jun. 10, 1996, Pat. No. 5,692,552, which is a continuation-in-part of application No. 08/384,136, Feb. 6, 1995, Pat. No. 5,573,051.

[51] Int. Cl.[7] ..... E06B 9/06

[52] U.S. Cl. ..... 156/70; 156/292; 160/84.05

[58] Field of Search ..... 156/70, 160, 291, 156/292; 160/84.05

[56] References Cited

U.S. PATENT DOCUMENTS

| | | |
|---|---|---|
| Re. 30,254 | 4/1980 | Rasmussen . |
| 262,399 | 8/1882 | Gibson et al. . |
| 1,937,342 | 11/1933 | Higbie . |
| 2,140,049 | 12/1938 | Grauel . |
| 2,162,226 | 6/1939 | McKinney . |
| 2,200,349 | 5/1940 | Walker . |
| 2,231,778 | 2/1941 | Swanson . |
| 2,307,278 | 1/1943 | Krantz . |
| 2,374,591 | 4/1945 | Dunn . |
| 2,381,060 | 8/1945 | Kahn . |
| 2,397,765 | 4/1946 | Sylvanus . |
| 2,401,283 | 5/1946 | Williams . |
| 2,405,579 | 8/1946 | Hunter . |
| 2,407,554 | 9/1946 | Isserstedt . |
| 2,537,865 | 1/1951 | Stuber et al. . |
| 2,572,224 | 10/1951 | Walker . |
| 2,573,700 | 11/1951 | Ferguson et al. . |
| 2,576,159 | 11/1951 | Walker . |
| 2,583,031 | 1/1952 | Walker . |
| 2,587,756 | 3/1952 | Palmisano . |
| 2,591,750 | 5/1952 | Walker . |
| 2,632,506 | 3/1953 | Walker . |
| 2,687,770 | 8/1954 | Walker . |
| 2,690,215 | 9/1954 | Croxen . |
| 2,783,831 | 3/1957 | Moyer . |
| 2,865,446 | 12/1958 | Cole . |
| 2,914,122 | 11/1959 | Pinto . |
| 3,294,153 | 12/1966 | Fountain . |
| 3,384,519 | 5/1968 | Froget . |
| 3,460,601 | 8/1969 | Abraham . |
| 4,019,554 | 4/1977 | Rasmussen . |
| 4,069,857 | 1/1978 | Brookshire . |
| 4,168,735 | 9/1979 | Frei . |
| 4,200,135 | 4/1980 | Hennequin . |
| 4,621,673 | 11/1986 | Georgopoulos et al. . |

(List continued on next page.)

FOREIGN PATENT DOCUMENTS

| | | |
|---|---|---|
| 249985 | 5/1963 | Australia . |
| 35 25 515 | 1/1987 | Germany . |
| 630127 | 11/1949 | United Kingdom . |

*Primary Examiner*—Daniel Stemmer
*Attorney, Agent, or Firm*—Buchanan Ingersoll, P.C.

[57] ABSTRACT

A method for making a material structure which has at least one section of first material spaced apart from at least one section of second material. A number of thin, elongated strands connect the first material to the second material. The strands may adhere to the first and second material along a transverse edge of each material or may instead adhere to a side of the material sections at some distance from the edge. The resulting material structure may be incorporated into clothing or into window shade structures, for example. The method is performed by positioning an adhesive applicator such that adhesive can be dispensed to form strands which contact and bond the first material. The applicator is moved away from the first material so as to form an elongated strand between the first material and the applicator. The applicator is then moved such that the strand contacts the second material so that the strand connects the first material to the second material. These steps are then repeated while indexing the applicator such that any bonding point along the first material and the second material is adjacent to a previous bonding point.

12 Claims, 18 Drawing Sheets

U.S. PATENT DOCUMENTS 4,625,786 12/1986 Carter et al. .
4,651,794 3/1987 Bytheway, Jr. .
4,697,630 10/1987 Rude .
4,708,188 11/1987 Bytheway, Jr. .
4,723,586 2/1988 Spangenberg .
4,869,308 9/1989 Chang .
4,917,168 4/1990 Chen .
4,940,070 7/1990 Warden .
4,951,729 8/1990 Yu .
4,984,617 1/1991 Corey .
5,043,039 8/1991 Swiszcz ..... 160/84.05
5,060,709 10/1991 Simon .
5,104,469 4/1992 Colson .
5,123,472 6/1992 Nagashima et al. .
5,139,069 8/1992 Hong ..... 160/84.04
5,139,072 8/1992 Marocco .
5,207,261 5/1993 Castraz .
5,228,491 7/1993 Rude et al. .
5,232,037 8/1993 Fraser .
5,285,838 2/1994 Rapp et al. .
5,309,974 5/1994 Fraser .
5,341,865 8/1994 Fraser et al. .

FIG. 4
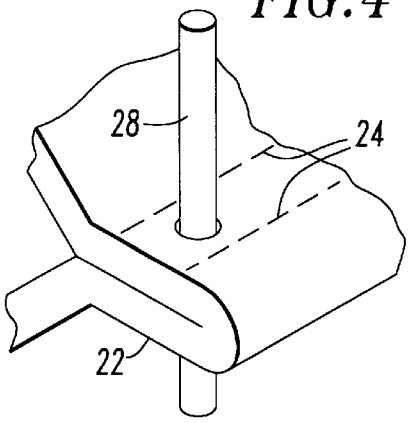
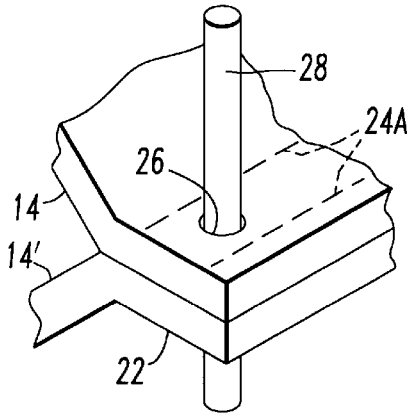
FIG. 4A
FIG. 5
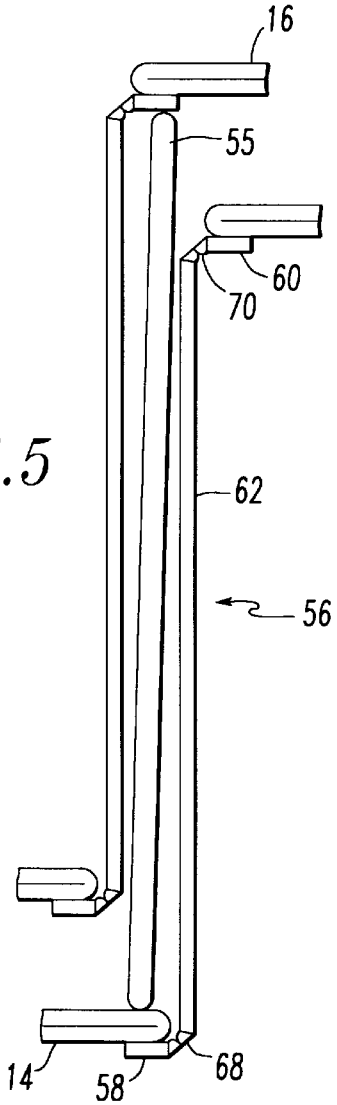
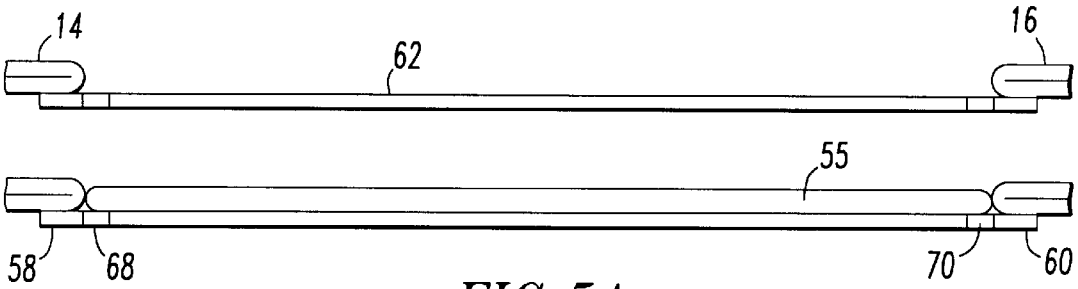
FIG. 5A

FIG. 6
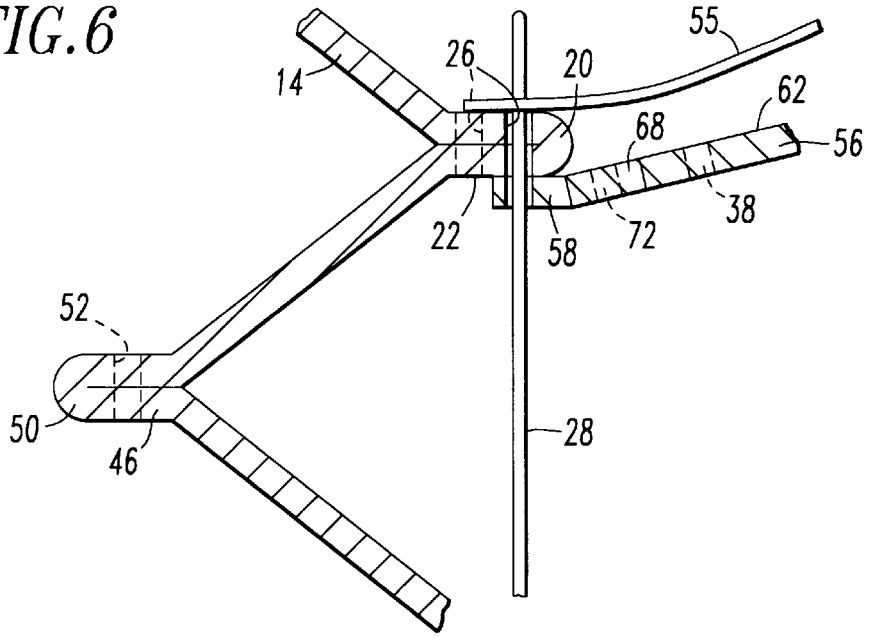
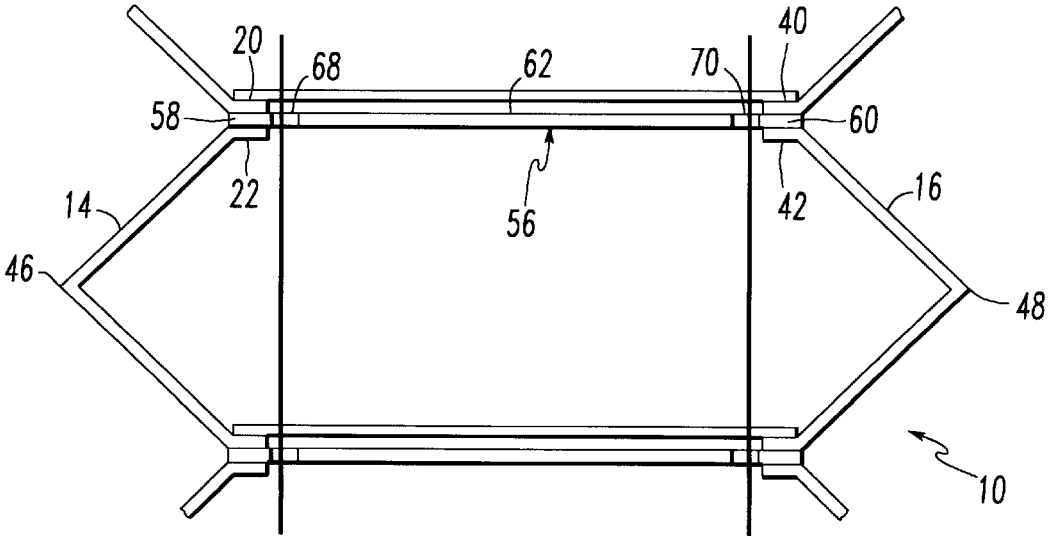
FIG. 7

FIG. 17c
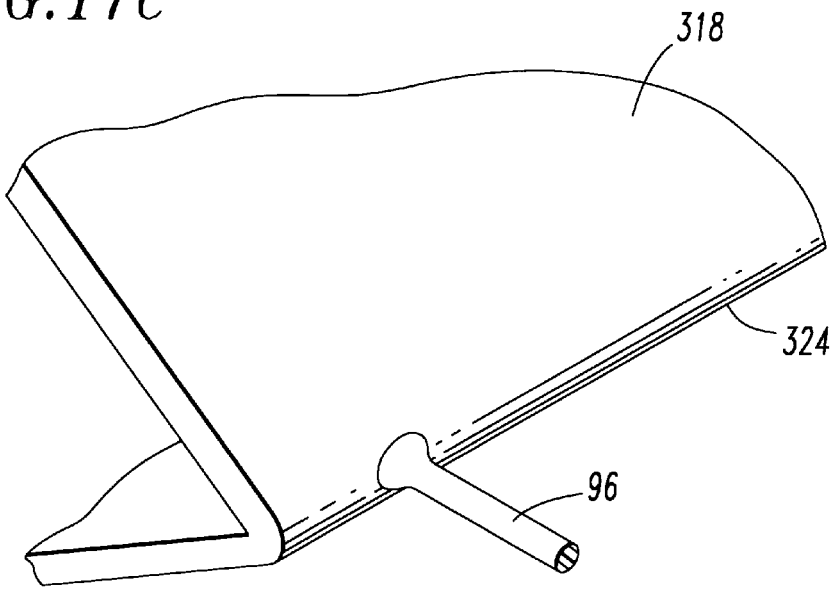
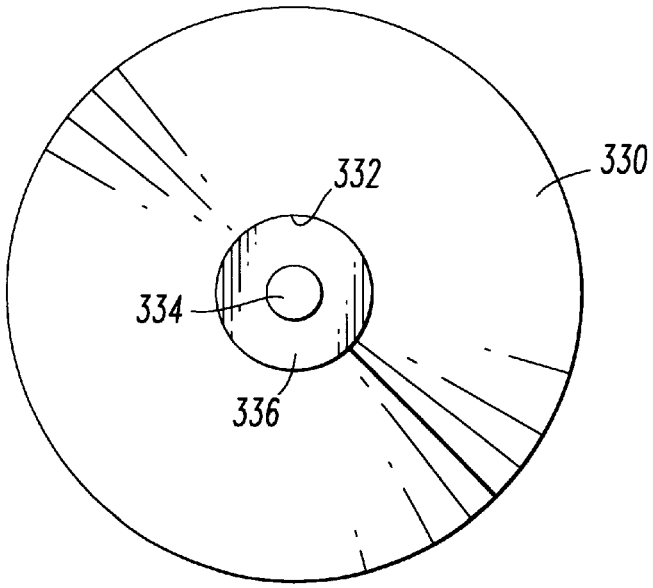
FIG. 19

FIG. 18a
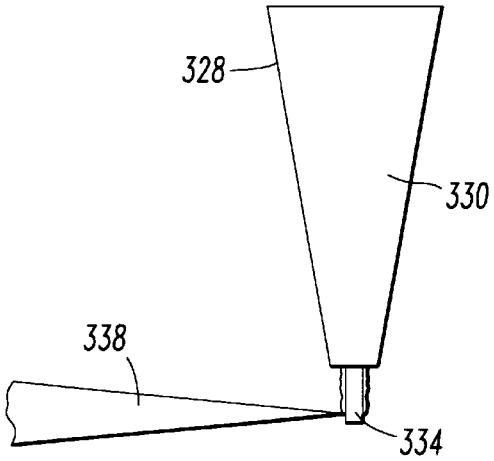
FIG. 18b
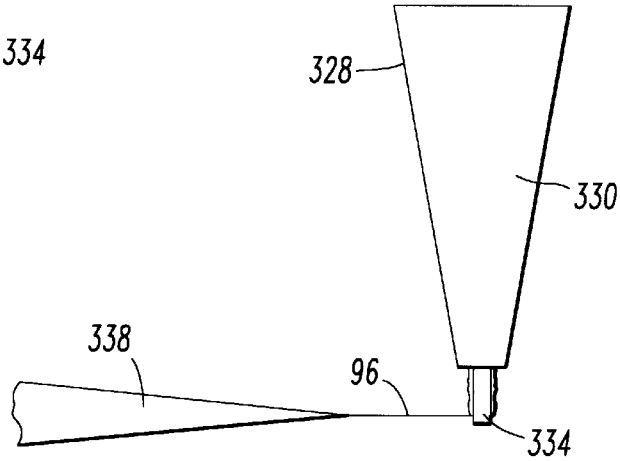
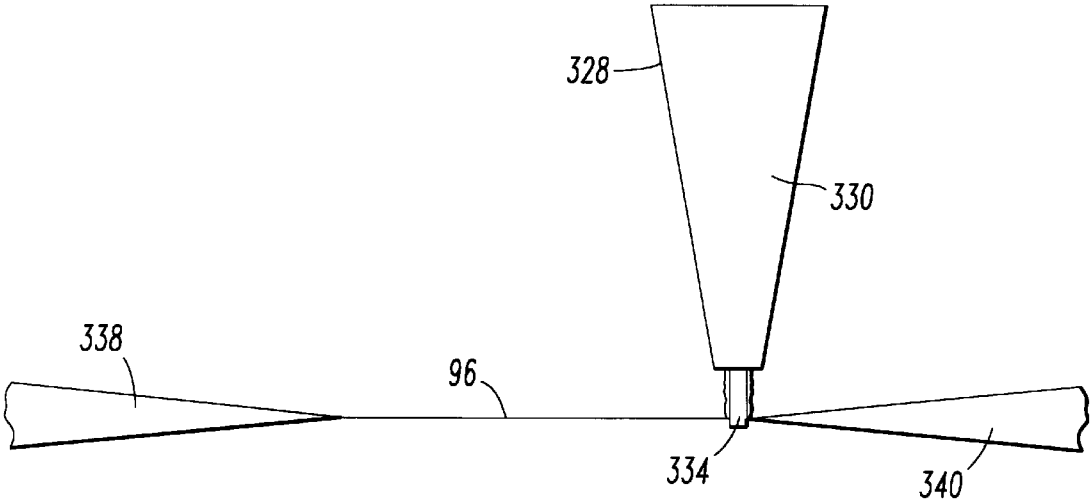
FIG. 18c

MATERIAL FOR VENETIAN TYPE BLINDS

RELATED APPLICATION

This application is a division of U.S. patent application Ser. No. 08/838,007, filed Apr. 14, 1997, which is a continuation-in-part of application Ser. No. 08/293,751, filed Aug. 22, 1994, now U.S. Pat. No. 5,620,035, which is a continuation-in-part of application Ser. No. 952,645, filed Sep. 28, 1992, now U.S. Pat. No. 5,339,882 and the present application is also a c-i-p of Ser. No. 08/661,192, filed Jun. 10, 1996, now U.S. Pat. No. 5,692,552, which is a continuation of application Ser. No. 08/384,136, filed Feb. 6, 1995, now U.S. Pat. No. 5,573,051.

BACKGROUND OF THE INVENTION

1. Field of the Invention

This invention relates generally to the field of fabrics and other sheet materials used as window coverings particularly venetian type window coverings.

2. Description of the Prior Art

The window shade industry has developed many methods and apparatus for covering windows that provide privacy and thermal insulation while being aesthetically pleasing. Such window coverings should be capable of being raised and lowered as access to the window and other factors dictate. It would be advantageous to provide a venetian-type window covering that could, without being raised or lowered, be selectively placed in a closed position that provides privacy and insulation. The window covering should also be capable of being moved into an open position, allowing light to pass through the window covering. The opacity, color, and texture of the slats are primary ingredients to the overall appearance and effectiveness of the covering.

One attempt to provide such a window covering is disclosed in U.S. Pat. No. Re. 30,254 to Rasmussen. Rasmussen shows a honeycomb curtain structure that operates as a venetian-type window cover. Rasmussen accomplished this by forming a curtain structure from a series of foldable cells adhered together. Each cell has opposed side portions and a connected part. Thus, when the cells are connected, the top and bottom connected portions of each cell form the lamellae or slats of the venetian type structure. The features of the slat structure is limited by all the other requirements of the cell construction.

Another attempt to provide such a venetian-type window covering is disclosed in U.S. Pat. No. 3,384,591 to Froget. Froget shows a composite cloth which may be used as a blind. When the cloth is used as a blind, it is comprised of two transparent sheets connected by movable and opaque blades which are parallel to one another and are regularly separated and welded to the sheets. Welding or bonding the edges of these blades or slats is difficult to accomplish and the features of the slats are compromised to that end.

Colson in U.S. Pat. No. 5,490,553 and Moser in his German Patent No. DE 3525515 A1 show slats inserted into pockets formed by portions of the front and back layers. Although this allows for a different selection of materials for the slat than in Froget and Rasmussen, it is still limited by the necessity or difficulty of sliding a slat into a long narrow pocket. Further any texture or color of the slat is muted by the overlaying layer of pocket fabric.

In each of the above-referenced applications, there is difficulty or limitations in providing color, texture, flexibility, or opacity to the product with the slat. Froget and Rasmussen must make an entire layer for each quality, that is color, texture, or opacity of the slat. This is very expensive for the regional fabrication/distribution system in this country to inventory. Colson and Moser can use one multi-layer fabric assembly with many different slat colors and opacities, but the qualities of those slats are muted by the mesh of the surrounding pocket.

Another important feature is easy removal or replacement of the slat. This allows the consumer to readily clean the product or replace stained or faded slats. The consumer may even wish to change colors or patterns to match the season, a red for Christmas or a green for spring.

SUMMARY OF THE INVENTION

I provide a honeycomb window covering structure that operates as a venetian. The present window covering structure has two sheets of material. The sheets are spaced apart and are oriented so as to be generally parallel to one another. A series of elongated slats or threads connects the first and second sheets of material. If slats are used, they vary from those previously described in that they are generic and are intended to be augmented by another secondary slat inserted by the fabricator, retailer, designer, or even the consumer. To distinguish the slats that are integral to the multi-layer assembly from the secondary or insertable slats, I shall call the connecting threads or integral slats elongated slats or bridges. These bridges would be neutral and generic. For example, they might be a simple reflective white in transparent, translucent, and opaque. By inserting different colored slats and opacities, a fabricator can achieve a tremendous variety of choices with an inventory of only three multi-layered fabric assemblies. The difficulty is how to maintain these slats in the assembly while still allowing for a potentially large difference in the coefficient of expansion between the multi-layer fabric assembly and the slat and easy insertion and removal. I overcome this difficulty by providing cords which fit into slots on opposite edges of the secondary slats.

A preferred embodiment of the window covering structure has a sheet of first material and a sheet of second material that are preferably pleated so as to have a plurality of transverse folds lying on the sheets. The folds are alternatingly directed in opposite directions to one another such that one side of the sheet of first material has a series of inward-directed pleats disposed thereon. The opposite side of the sheet of first material defines a front of the structure and has a series of outward-directed pleats disposed thereon. Similarly, one side of the sheet of second material has a series of inward-directed pleats disposed thereon. The other side of the sheet of second material defines a rear of the structure and has a series of outward-directed pleats disposed thereon. The sheets of material are preferably made of a continuous, single piece of fabric, but sections of material may be spliced together to form the sheets of material.

The first and second material sheets are spaced apart and oriented so that each inward pleat of second material is directed towards a corresponding inward pleat of first material. Each corresponding set of first material inward pleats and second material inward pleats are connected by an elongated slat or a series of strands. Each elongated slat has a first tab and a second tab. The first slat tab is affixed to the inward pleat of first material and a second slat tab is affixed to the inward pleat of second material. Each elongated slat also has an intermediate portion lying between the first slat tab and the second slat tab, in which the intermediate portion is connected to the first slat tab by a first hinge and is connected to the second slat tab by a second hinge. The hinges may be separate elements or may be of the same material as the elongated slats. The hinges are preferably formed when made of the same material as the elongated slat by folding or bending the slats at the appropriate locations or alternately when a woven material is used for the elongated slats some material may be removed at the hinge location. Any convenient means of facilitating the folding of the slat at the appropriate location may be used to create the hinge. A second, preferably removable slat is placed on each elongated slat.

When the sheets of first and second materials are positioned relative to one another such that the structure is in an open position, the elongated slats are spaced apart and are generally parallel to one another and generally perpendicular to the first and second material sheets. When the first and second material sheets are moved into a closed position, the elongated slat intermediate portions are moved about the hinges such that the intermediate portions are spaced apart and are generally aligned with one another and the face surface of each elongated slat is substantially parallel to the first and second material sheets. The second slats may be parallel to the elongated slats or slightly angled away from the elongated slats. However, the slat tabs remain substantially perpendicular to the sheets of first and second material regardless of whether the structure is in the closed position or open position. By remaining perpendicular to the first and second sheets of material, the slat tabs ensure that the structure has a honeycomb configuration in both the open and closed positions while providing a space for a selected number of cords to run through without interfering with the tilting of the structure through the open and closed positions and conversely providing a cord path that will not become restricted when the structure is moved through the open and closed positions.

The first sheet of material and the second sheet of material are both preferably made of a material that does not act as a barrier to heat or light such as an open-weave polyester. In the open position, the elongated slats and the second slat resting on each elongated slat are spaced apart, are parallel to one another and are sufficiently thin so that the thin edges of each slat facing to the front and rear of the structure do not substantially obstruct heat and light from passing therethrough. Thus, one operating the window covering structure when facing either the front of the structure or the rear of the structure would be able to see through the window covering structure when it is in the open position. However, when the structure is in a closed position the face surfaces of the slat intermediate portions become aligned and preferably overlap slightly facing the front and rear of the structure. Thus, a barrier is formed by the slats preventing heat and light from passing to and from the front and rear of the structure.

When it is desired to raise or lower the structure, the structure may be wound and unwound around a roller or may be raised and lowered by lift cords that are attached to the bottom of the structure.

In another preferred embodiment, the inward pleats have tabs formed at their ends. The first slat tab is then affixed to a tabbed pleat of first material and the second slat tab is then affixed to a tabbed pleat of second material. The slat tabs are preferably affixed to the pleat tabs in an overlapped fashion. The overlapped pleat tabs and slat tabs thus form the connecting portions of this embodiment. Holes may be placed in the tabbed inward pleats so that one or more lift cords may each be disposed through a series of holes. Alternatively, holes for the lift cords may be placed in either or both of the hinges of each slat or in the slat tabs. In the instance when the structure is raised by lift cords, the structure is able to collapse upon itself yielding a tight stack.

Another preferred embodiment of the window covering structure is substantially identical to the preferred embodiments described above except that the folds or pleats of the first and second sheets of material are directed toward only one side of each sheet of material respectively. The pleats may have tabs formed on them as described above. Thus, the sheets of material of this embodiment have extensions that extend outward from one side only of each sheet. The alternative sheets of material for this embodiment may be formed by folding a continuous sheet, or by splicing several sections of material such that a portion of the spliced sections of material extend outward, or by affixing separate pieces of material to the first and second sheets of material. Therefore, the extensions from the sheets of material of this embodiment may be tabbed or untabbed pleats or affixed sections of material. Each corresponding set of extensions of the sheet of first material and the sheet of second material are connected by the hinged elongated slat of the first embodiment. Also, a structure could be made that used one sheet of material having pleats directed towards both sides as described in the first embodiment and the other sheet of material may have pleats directed towards only one side of the sheet. A second, preferably removable slat rests on each elongated slat.

Another preferred embodiment is substantially identical to the above described embodiments except that straight, continuous sheets of first and second material are used. Therefore, no extensions from the sheets of material are present. The hinged elongated slats of the first embodiment are abuttingly affixed to the first sheet of material and second sheet of material.

In any of the above-described embodiments, an alternative elongated slat may be used. The alternative elongated slat is a straight unhinged member. One end of the elongated slat is affixed to the first material and an opposite end of the elongated slat is affixed to the second material. The elongated slats are affixed to the first and second material by a flexible adhesive that also acts as a hinge. The flexible adhesive connecting portions may have holes placed in them so that lift cords may be disposed therethrough.

A preferred material structure to be incorporated into any of these window designs or which may be utilized for other applications, such as for the fabrication of clothing, will be now described. A first section of material can be connected to a second section of material by a number of relatively fine, yet strong, formed strands. Preferably, the formed strands are connected to the sections of material along respective transverse edges of the sections of material. The strands may be fabricated by extruding a suitable curable material, preferably a curable liquid, through a very small orifice. The liquid begins to solidify when it makes contact with the ambient environment. By touching a surface with the orifice, the strand can be attached to the surface before it completely solidifies. The formed strands and the connections or bonds they make with a surface are extremely fine and very strong. There are many thermoplastic and thermosetting synthetic adhesives and polymers that could work effectively in connection with this method.

It is preferred that the adhesive strands be connected to the transverse edges or creases of the sections of material rather than being bonded flat upon the surface of the fabrics. However, the characteristics provided by the strands, e.g., increased flexibility and ideal path for placement of the lift cords, may also be achieved by attaching the strands a relatively short distance back from the edges of the material, upon the flat surface of the fabrics.

The formed strands may be produced by any convenient means. A preferred means for forming the strands involves providing a curable liquid in a well. The well has at least one orifice sized to match the viscosity and surface tension characteristics of the particular liquid selected, such that when contact is made with another surface, a strand is pulled off of the orifice when the two surfaces are separated. For example, a movable applicator having a tip or post disposed through the orifice of a well may be heated such that a thermoplastic resin provided therewithin is maintained in a liquid form. When the post touches one section of fabric, the liquid flows by capillary action onto that surface. As the heated tip moves away from the that section of material, it trails a strand that cools and solidifies almost immediately. The heated tip may then move into contact with the second section of material bonding the thread to that section of material.

Once the applicator carrying the liquid adhesive makes contact with the first section of material, it may move towards the opposed second section of material at some slight angle and repetitively moved back and forth at an angle, creating a zig zag pattern of formed strands. Alternatively, after a strand is formed, the applicator may be repositioned adjacent the previous contact point along the first section of material and then moved back toward the second section of material and repeated, thereby creating a plurality of essentially parallel strands. Also, after a strand has contacted the second section of material, the applicator may be repositioned adjacent the contact point of the second section of material and moved back toward the first section of material, repositioned along the first section of material and repetitively so moved such that a plurality of generally parallel strands are formed. Preferably, the plurality of strands are bonded to confronting transverse edges of the first and second sections of material, although they may alternatively be bonded to the flat surfaces of the sections of material. The above described method may be modified so that the threads are formed not along a transverse edge or crease but are formed back from the edge a selected distance. The threads would still be provided transversely along the material sections.

In this way, a plurality of threads extend transversely between two sections of material, connecting those sections of material. As will be readily understood with the descriptions and figures of the preferred embodiments, in many applications of the present invention, such as in use in window covering structures, several rows of transverse strands may connect the two sections of material.

The problems associated with bonding thin edges of fabric together, i.e., accurate location and holding of the fabric members and delivering of small amounts of adhesive over a long length, may be overcome by the method of the subject invention. In the present invention, a well of a curable liquid having an opening at the bottom thereof and a post disposed through the well opening is utilized. This type of applicator may be suitably placed in the gap between the two pieces of fabric and the post always finds the transverse edge or crease of a section of fabric and places a precise amount of liquid on them even if they are not in the exact plane in which they should be situated. The post takes advantage of the soft nature of the fabric or material to which it applies the strand to absorb a slight bump that assures that contact is always made with the material. The strands that are formed minimize the amount of strand material needed. Additionally, the formed strand will typically be applied at a 90° angle to the material, which means that the bonds are practically invisible and can be placed so that they do not need to support the weight of the fabric layers or be submitted to peel-type loading.

In the case where the sections of material connected by the strands are used in a window shade structure, it is preferred that at least one of the two sections of material is a sheet of pleated material. Thus, the edge of each pleat creates the transverse edges of that first section of material. The second section of material may also be a pleated sheet such that an inward pleat of the first section of material is connected to a respective inward pleat of the second section of material. The two pleats may be bonded directly by the strands thereby forming a honeycomb fabric structure. Although at least one of the sections of material are preferably pleated, it is understood that both sections of material may be unpleated. In this embodiment, a series of transverse rows, each comprised of a plurality of strands, connects the two sections of material. The resulting window shade structure is of a roman shade type.

As an alternative, a connecting member such as a rigid slat or a length of flexible ribbon may be positioned between the two inward pleats so as to provide a venetian-type window structure. In the venetian-type window structure, one transverse end of the elongated slat is connected to an inward pleat of the first section of material by a plurality of strands, and a second transverse end of that slat is connected to a respective inward pleat of the second section of material. Of course, the sections of material may be unpleated for any of the embodiments.

Alternatively, when the material structure is used as a window shade fabric, the first section of material may be a pleated sheet of fabric and the second section of material may be a plurality of ribbons or cords. Thus, in this embodiment, an inward pleat of the first section of material is connected to a respective ribbon or cord by a plurality of strands.

The plurality of formed strands used as a connection offers many benefits over the prior art. Aside from being aesthetically pleasing, lightweight and strong, the spaces between the strands make ideal locations for placing lift cords therethrough. Also, the strands may function as a hinge or flexure location in which the two sections of material in the material structure may shift position relative to one another. The longer the strands the greater the tolerance for errors in sizing the width of the elongated slats and the spaces between these slats. This is because the strands are so flexible that they bend to accommodate the difference. Having a secondary or insertable slat can hide the hinge and make a tighter overlap pattern and width to space ratio since the slat essentially floats on the elongated slat and hinges and will not jam the layers if the space between the elongated slats does not match the tilt travel precisely. The tilt travel is the total vertical displacement of one or both of the vertical sheets of material.

Other objects and advantages of the invention will become apparent from a description of certain present preferred embodiments thereof shown in the drawings.

BRIEF DESCRIPTION OF THE DRAWINGS

FIG. 4 is a perspective view of a portion of a shade showing a tab.

FIG. 4A is a perspective view of a portion of a second preferred embodiment of the window covering structure showing an alternative tab.

FIG. 5 is a side view of a portion of the first preferred window covering structure in a stacked position showing a Z-shaped configuration. The outward extending pleats have been cut away for clarity.

FIG. 5A is a side view of a portion of the first preferred window covering structure in a stacked position showing a flat configuration. The outward extending pleats have been cut away for clarity.

FIG. 6 is a cross sectional view of a portion of the first preferred window covering structure.

FIG. 7 is a side elevation view of a portion of a third embodiment of the window covering structure which has an alternative means of affixing the slats to the first and second material.

FIG. 17C is a perspective view of a portion of a pleated, untabbed panel showing a strand attached to a transverse edge thereof.

FIG. 18A shows a first step in the preferred method of forming a strand between two sections of material.

FIG. 18B shows a second step in the preferred method of forming a strand between two sections of material.

FIG. 18C shows a third step in the preferred method of forming a strand between two sections of material.

FIG. 19 is a bottom view of the preferred applicator for dispensing the curable liquid.

DETAILED DESCRIPTION OF THE PREFERRED EMBODIMENTS

The present window covering structure has two sheets of material. The sheets are spaced apart and have a series of spaced apart elongated slats or bridges connecting the first material with the second material. Connecting each elongated slat to the first and second sheets of material, respectively, are first and second connecting portions. The connecting portions may be tabs formed on pleats of the first and second material, tabs formed on the elongated slats themselves, extending portions that extend to one side of each sheet of material may be a separate structure such as separate sections of material affixed to the sheets of material, or a flexible adhesive between the elongated slats and the first and second material, or any combination thereof. The connecting portions provide a space through which lift cords may be run and also allow the window covering structure to retain a honeycomb configuration in both the open and closed positions.

Figure 1:
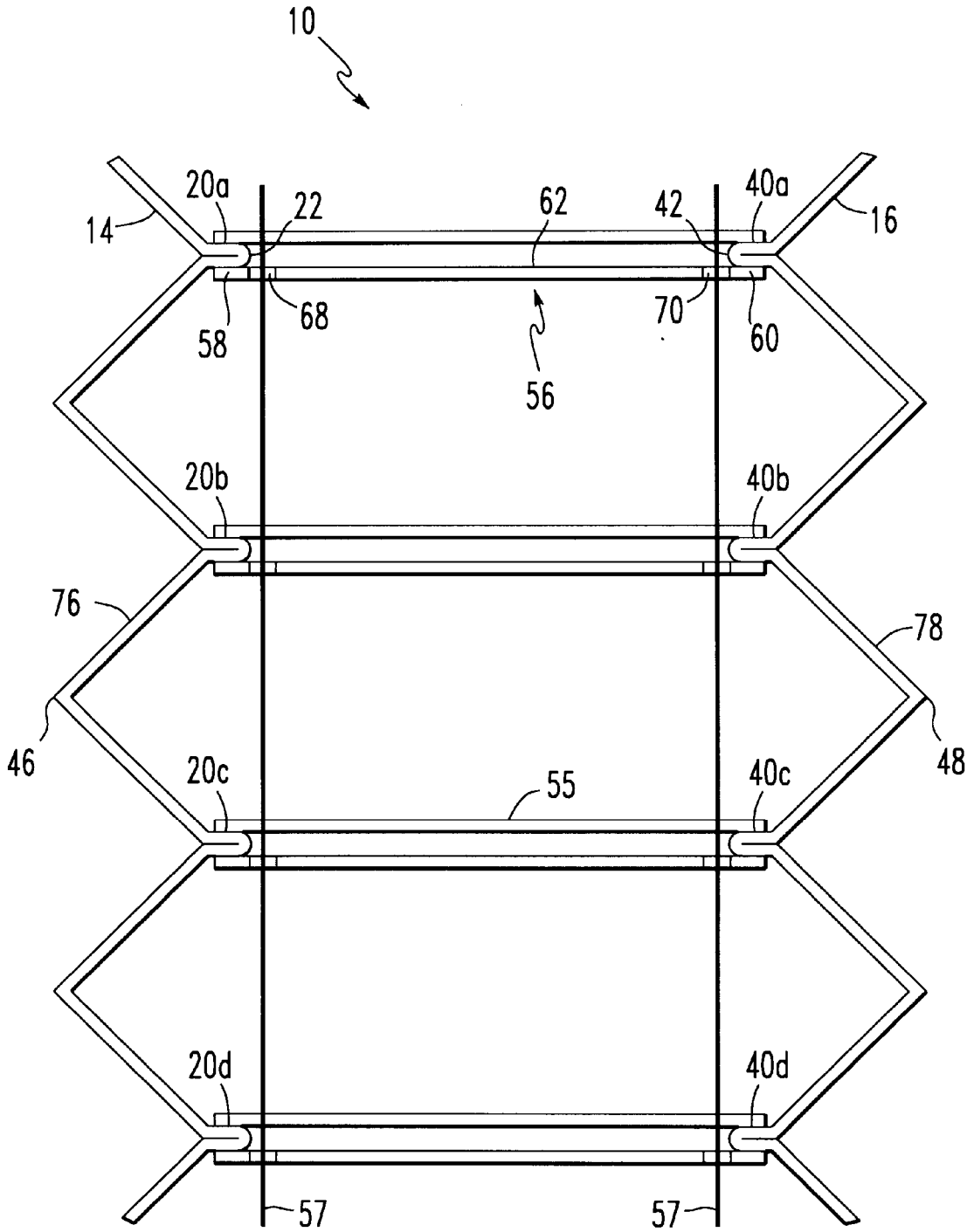
FIG. 1 is a side elevation view of a portion of the first preferred window covering structure in the open position.
Figure 2:
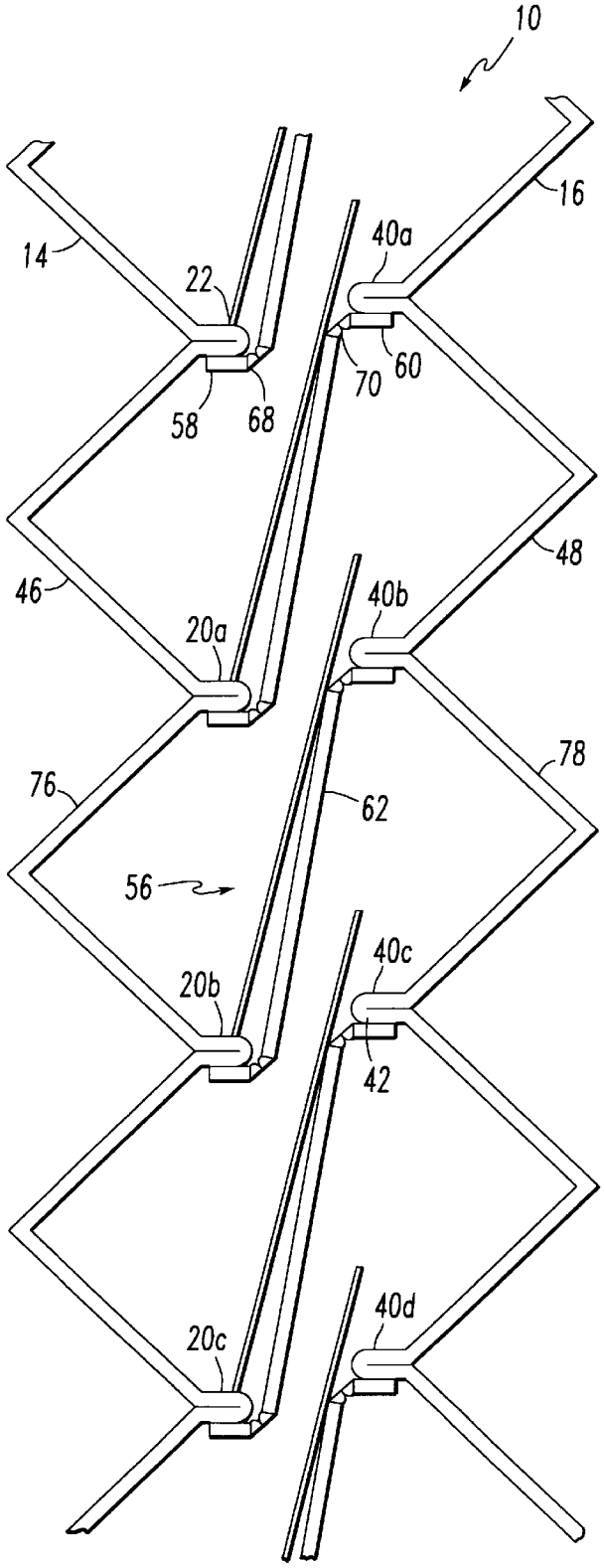
FIG. 2 is a side elevation view of a portion of the first preferred window covering structure in the closed position.
Figure 3:
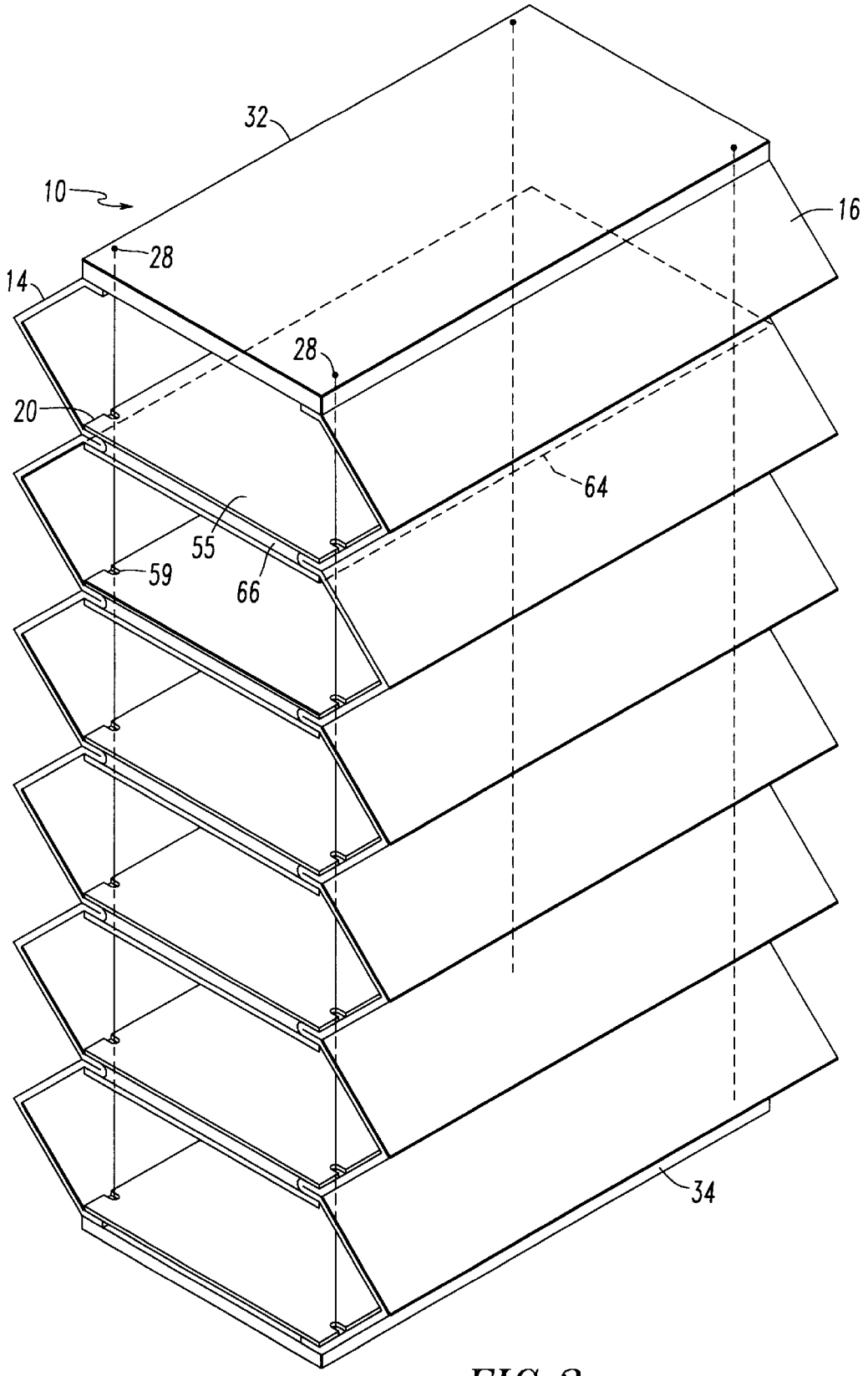
FIG. 3 is a perspective view of the first preferred window covering structure in an open position.

Referring first to FIGS. 1, 2 and 3, a first preferred embodiment of the honeycomb window covering structure 10 is shown. Structure 10 has a sheet of first material 14 and a sheet of second material 16. Preferably, first material 14 and second material 16 are pleated so as to have a plurality of transverse folds lying on the sheets. The folds are alternatingly directed in opposite directions to one another such that one side of the sheet of first material 14 has a series of inward-directed pleats 20*a* through 20*d*. The opposite side of the sheet of first material 14 defines a front 76 of the structure and has a series of outward-directed pleats 46. Similarly, one side of the sheet of second material 16 has a series of inward pleats 40*a* through 40*d*. The opposite side of the sheet of second material 16 defines a rear 78 of the structure and has a series of outward pleats 48. Preferably, inward pleats 20*a* through 20*d* have tabs 22 formed on them. Similarly, the inward pleats 40*a* through 40*d* preferably have tabs 42 formed on them. The first material 14 and the second material 16 are each preferably made of a transparent material that does not act as a barrier to heat or light. Additionally, the outward pleats 46 and 48 of both the first material 14 and the second material 16 may be formed with tabs 50 as shown in FIG. 6.

In the embodiment of FIG. 1, the first material 14 and second material 16 are spaced apart and are oriented relative to one another such that each tab 42 of second material is directed towards a corresponding tab 22 of first material. Each corresponding set of first material tab 22 and second material tab 42 are connected by an elongated 56. Elongated slat 56 has a first slat tab 58 that is affixed to the first material tab 22. Each elongated slat 56 also has a second slat tab 60 that is affixed to the second material tab 42.

The elongated slats are connected to the first and second materials 14 and 16 by any convenient means such as sewing, melting or through adhesives. When the slat portions 58 and 60 are affixed to tabs 22 and 42, the elongated slat portions may be affixed to any portions of the tabs 22 and 42 and may thus overlap over the entire length of the tabs 22 and 42, extend over only a portion of the tabs 22 and 42 or may be abuttingly affixed to the tabs.

Each elongated slat 56 further has an intermediate portion 62 lying between the first slat tab 58 and the second slat tab 60. The slat intermediate portion 62 is connected to the first slat tab 58 by a first hinge 68. Similarly, the slat intermediate portion 62 is connected to the second slat tab 60 by a second hinge 70. The hinges 68 and 70 may be constructed of separate pivotable elements or may preferably be made of the same material as the elongated slats 56 formed in any convenient manner of facilitating bending of the material, such as by prefolding the elongated slats 56 at the appropriate locations or removing some material from the weave of slats made of woven material.

Each elongated slat 56 has opposed face surfaces 66 and longitudinal edges 64. Each elongated slat 56 is sized and configured so that the edges 64 are very thin relative to the face surfaces 66. The elongated slats 56 are preferably made of a thermally insulating, nontransparent material such as polypropylene film or tightly woven polyester. A second set of slats 55 shown in FIGS. 1 and 3 are placed on the elongated slats. A secondary slat 55 rests above each elongated slat and may or may not extend over the tabs 20 and 40. The cords 57 pass through the hinge areas 68 and 70 or they could pass through either of tabs 20 and 40. Slots 59 extend deep enough into the edge or preferably opposite edges of the secondary slats 55 to allow the cords to freely pass and also to restrain the secondary slats 55 from moving side to side or longitudinally. This retains the secondary slats 55 in the blind during normal operation but allows them to be removed and replaced easily. The slots 59 are wide enough to compensate for any difference in thermal expansion between the secondary slat 55 and the multi-layer fabric assembly 10. This prevents rippling of the secondary slat 55 in hot and cold conditions. By maintaining cords in tension at all times during the tilt and lift cycles, the secondary slats 55 will remain captive because the cords 57 will remain in their respective slots 59.

Selected successive inward pleats of first material 14 have been designated as 20*a* through 20*d* to demonstrate the operation of the structure. Likewise, selected corresponding successive inward pleats of second material 16 have been designated as 40*a* through 40*d* to demonstrate the operation of the structure. Thus, first material inward pleat 20*a* is connected to pleat 40*a* by a slat, while inward pleat 20*b* is connected to second material inward pleat 40*b* by a slat and so on.

In accordance with the teachings of this invention, and as may be seen in FIG. 4, the two sections of first material 14 forming each of the inward pleats 20 are secured together along substantially the entire width of the shade and at a point a short distance from the pleat to form a plurality of tabs 22. The joint or seam 24 which results in the tabs 22 may be formed by welding, sewing, gluing or other suitable means. For a preferred embodiment of the invention, the joint is formed by ultrasonic welding. The length of the tabs 22 will vary with each application.

The memory, strength and rigidity of pleats may be significantly enhanced by providing a multiple bond or a continuous bond between the fabric layers forming each tab. Thus, a single or multiple bond joint may be provided. Alternatively, the two sections of material may be adhered together over substantially the entire area, or the tabs may be separate elements affixed to the sheets of material.

In a second preferred embodiment, shown in FIG. 4A, a bond joint 24*a,* in this case a double weld joint such as that shown in FIG. 4, is being utilized to splice together two pieces of first material 14 and 14' rather than to merely secure together two sections of the same piece of material. Thus, the first and second materials 14 and 16 may be a continuous sheet of fabric or may be a sheet of fabric formed by the splicing of separate pieces of fabric. The joint 24*a* still results in the formation of a tab 22 that may have cord holes 26 formed therein through which a cord 28 may pass. The pieces of material may be spliced together by any convenient means. In a third preferred embodiment of the window covering structure, the slats may be affixed to the spliced tabs by being disposed between the two pieces of material and being bonded therewithin as shown in FIG. 7.

The formation of tabs has been to this point discussed in terms of the inward pleats of first material. However, it is understood that the second material may also have tabs 42 formed in the above described manner on the inward pleats. Furthermore, it is also understood that the above described formation of tabs is also applicable to the formation of tabs 50 on the outward pleats of first and second material 14 and 16 as shown in FIG. 6.

This window covering operates much like a venetian blind. By manipulating the position of the first material 14 and second material 16 relative to one another, the window covering structure 10 may be placed in an open position as shown in FIG. 1 or closed position as shown in FIG. 2. The open position is formed when the inward pleats of first material are directed towards the corresponding inward pleats of second material. Thus, in the open position. inward pleat 20*a* is directed towards inward pleat 40*a,* inward pleat 20*b* is directed toward inward pleat 40*b* and so on. With the corresponding inward pleats being directed toward one another, the slat intermediate portions 62 are caused to be spaced apart and generally parallel to one another. Thus, in the open position, the thin edges 64 of each elongated slat 56 and second removable slat 55 are directed towards the front 76 and rear 78 of the structure 10. The edges 64 are sufficiently thin so that they do not substantially obstruct heat and light from passing between the front 76 and rear 78 of the structure 10.

Referring next to FIG. 2, the structure 10 may be moved into a closed position. Once, in the closed position, the intermediate portion 62 of each elongated slat 56 become coplanar and preferably overlap slightly. In this aligned position, the slat face surfaces 66 are generally parallel with the front 76 and rear 78 of the structure 10. Thus, a barrier is formed by the elongated slats 56 and secondary slats 55 when the structure 10 is in the closed position, preventing heat and light from passing to and from the front 76 and rear 78 of the structure 10.

As can be seen by comparing FIGS. 1 and 2, the elongated slats 56 are able to move about hinges 68 and 70. As elongated slats 56 are moved about hinges 68 and 70, the relative position of the first material 14 to the second material 16 is shifted. In this manner, the structure 10 may be placed selectively into either the open or the closed position by adjusting the position of the first material 14 and second material 16 relative to one another. The amount of shifting of the first material 14 and second material 16 relative to one another necessary to effectuate a change between the open and closed positions is dependent upon the width of the elongated slat intermediate portions 62 and the width of the secondary slat resting thereon. The hinges 68 and 70 enable the intermediate portion 62 of each elongated slat to pivot relative to the slat first and second tabs 58 and 60, allowing the intermediate portions 62 and secondary slat 55 resting thereon to be moved from parallel and spaced apart from one another as shown in FIG. 1 to being generally coplanar and overlapped as shown in FIG. 2. However, the hinges 68 and 70 of each elongated slat allow the first slat and second tabs 58 and 60 and the pleat tabs 22 and 42 to which they are affixed to remain generally perpendicular to the first and second sheets of material 14 and 16 whether the structure is in the open or closed position. The connecting portions for this embodiment are the overlapped pleat tabs and slat tabs. By remaining perpendicular to the first and second sheets of material 14 and 16, the connecting portions ensure that the structure has a honeycomb configuration in both the open and closed positions. The connecting portion tabs also provide a structure through which lift cords may be disposed that does not substantially tilt and therefore does not inhibit the travel of the lift cord through the cord hole.

The preferred amount of shift of the first and second materials relative to one another is the space between two adjacent pleats on a sheet of material plus the overlap. Thus, whether in the open position or closed position, the structure has a generally honeycomb configuration, as can be seen in FIGS. 1 and 2. The preferred shift of the relative position between the first and second materials 14 and 16 when the structure is in the closed position can be seen in FIG. 2. In the closed position, inward pleat 20*a* is now directed toward inward pleat 40*b*, inward pleat 20*b* is now directed toward inward pleat 40*c* and so on. Thus, the first and second materials 14 and 16 have been shifted by one pleat. The pleats in the drawings are shown with some fullness for clarity. They would actually be extended to a nearly vertical position.

For the structure 10 to be in either the open or closed position, the structure 10 must be extended as is shown in FIGS. 1 and 2. However, it is often desirable to have the structure 10 moved sufficiently out of the way of the window it is covering. In this instance, the structure 10 may be stacked as shown in FIGS. 5 and 5A. When the structure 10 is placed in the stacked position, outward pleats 46 and 48 are flattened and are placed in close proximity to one another. Similarly when the structure 10 is in the stacked position, the inward pleats of the first and second material are flattened and placed in close proximity to one another. When this flattening of the structure 10 occurs, elongated slats 56 are necessarily brought within close proximity to one another. The preferred stacking of the structure 10 results in a Z configuration as shown in FIG. 5. The Z configuration enhances closure when tilted. The stacking of the structure 10 may also selectively result in a flat configuration as shown in FIG. 5A.

Referring next to FIG. 6, a portion of the structure 10 is shown. Although FIG. 6 shows only a portion of the first sheet of material 14, elongated slat 56, and secondary slat 55 the second sheet of material 16 is a mirror image to which the description is equally applicable. The structure 10 has at least one lift cord 28 preferably provided through it so as to actuate the raising and lowering of the structure. The lift cord 28 is placed through holes 26 extending through the structure 10. The cord holes 26 may be placed on the inward tabbed ends of the pleats 20 and 22. As can be seen in the FIG. 6, the first slat tab 58 may be affixed to only a portion of tabs 22 and 42 so as to leave an area on tab 22 that is not affixed to the first slat tab 58. The cord holes 26 may be situated in this area thereby allowing the lift cord 28 to pass through a hole placed only in tabs 20 and 42 and not through the first and second slat tabs 58 and 60 as well. Alternatively, the cord holes 26 may be placed through both tabs 20 and 22 and the slat tab 58. Additionally, FIG. 7 shows the first and second slat tabs 58 and 60 may be affixed to the entire width of tabs 22 and 42 in which case a cord hole 26 placed through tabs 22 and 42 would extend through the first and second slat tabs 58 and 60 as well. The cord holes 26 may also be placed in the hinges, in which case it is preferred to have hinges 68 and 70 that are extended so as to allow a cord to readily pass through without restriction. Similarly, when the inward pleats of first and second material are not tabbed, the cord holes 26 may be placed through the inward pleats alone or through both the first and second slat tabs 58 and 60, or through the hinges 68 and 70.

The secondary slats 55 will be sized so teat the slots 59 will be sufficiently deep to allow the slat to extend beyond the cord far enough to insure that the secondary slat 55 is captured during normal operation. The size of the slat or slot will vary slightly depending on the placement of the hole 26 and thus the lift cords 28.

The lift cords 28 may alternatively be disposed through holes in either of or both of the hinges 68 and 70 of each elongated slat 56. The hinge holes 72, shown in dotted line in FIG. 6, allow the lift cord 28 to be disposed through the elongated slat and not the first or second material 14 and 16, while not placing a perforation on the face surfaces of the slats, thereby keeping privacy and insulation intact when the structure 10 is in the closed position. Slots 59 in the second set of slats 55 allow them to move with the elongated slats while being held in place by the lift cords.

Furthermore, holes for the lift cords may be placed in either of or both sets of outward pleats 46 and 48 or in the tabbed ends 50 of the outward pleats. The outward pleat holes 52 are shown in dotted line in FIG. 6. The outward pleat holes 52 also allow placement of the lift cords without affecting the privacy or insulation of the face surface barrier of the structure in the closed position. Alternatively, the cords may be placed on the outward pleat on one side and an inward pleat on the opposite side.

Although the holes for the lift cords 28 may also be placed on the slat face surface 66, this is not preferred as the holes 38 will allow the passage of heat and light when the structure 10 is in the closed position. This barrier to heat and light is left intact when the holes are placed on the inward pleats, outward pleats or hinges.

To assist in the raising and lowering of the structure 10, the structure may be mounted within a headrail 32 and a bottomrail 34 as shown in FIG. 3. Thus, an upper portion of the first and second materials 14 and 16 are affixed to the headrail 32. And the lower portion of the first and second materials 14 and 16 are affixed to the bottomrail 34.

In positioning the structure 10 into the closed or open position, it is unimportant whether the first material 14 is moved, the second material 16 is moved, or whether both the first and second materials 14 and 16 are moved. The opening and closing operation may be performed by any convenient means that would change the relative positions of the first and second materials 14 and 16 such as tilting the headrail, tilting any bottomrails or by placing separate lift cords through at least one of the first and second materials 14 and 16.

The first and second materials 14 and 16 are preferably formed of a perforated material. By maximizing the number and the area of the perforations, the material becomes virtually transparent and provides essentially no barrier to heat or light. The preferred first and second materials 14 and 16 are made of an open weave polyester. The first and second materials 14 and 16 may be made of the same material or may be made of different material. The weave patterns chosen for the first and second materials 14 and 16 should be ones that do not cause interference in vision when one views through both patterns. An advantage of the pleated nature of the first and second materials is that the tiny amount of angles off the vertical of the pleats combine to offset the moire effect. Preferably, whichever of the first and second materials that faces the interior of a room is colored, textured and patterned for aesthetic appeal. The opposite material which faces toward the outside of the window is preferably white.

Figure 8:
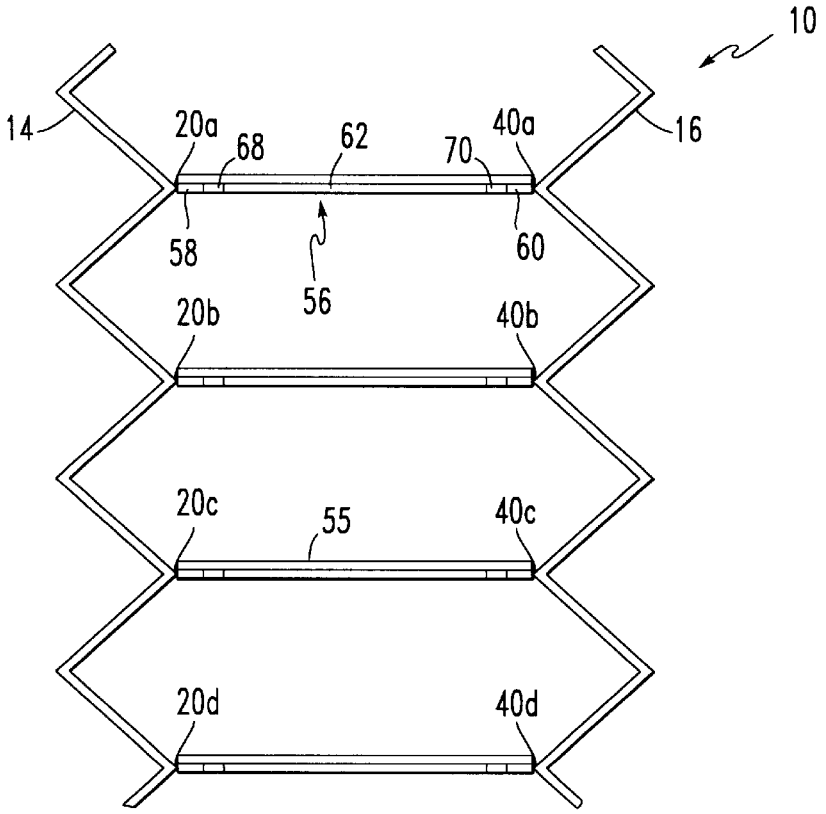
FIG. 8 is a side elevation view of a portion of a fourth preferred window covering structure having untabbed inward pleats.

Although it is preferred that the inward pleats of the first sheet of material 14 and second sheet of material 16 have tabs formed upon them, the pleats may be untabbed as shown in the fourth preferred embodiment of FIG. 8. The elongated slats 56 would be connected directly to the untabbed inward pleats. Thus, the slat first portion 58 and slat second portion 60 are abuttingly affixed to inward pleats 20*a* through 20*d* and 40*a* through 40*d,* respectively. In all other respects and in operation, the untabbed embodiment of the window covering structure is identical to the tabbed embodiments.

Figure 9:
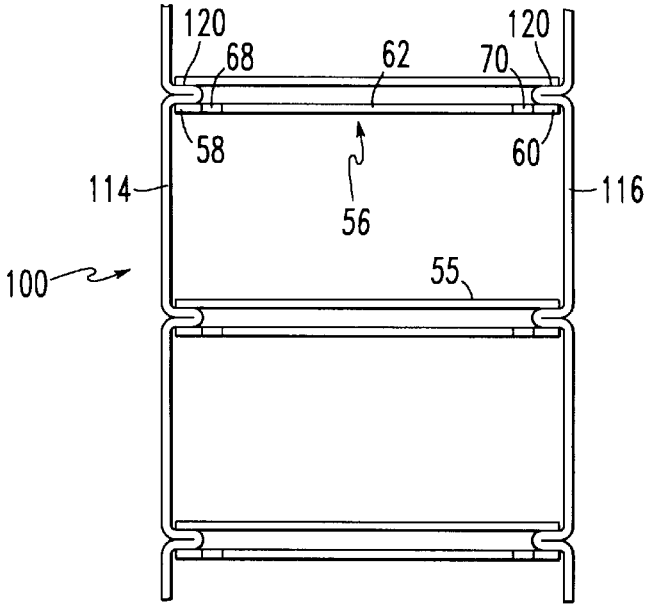
FIG. 9 is a side elevation view of a portion of a fifth preferred embodiment of the window covering structure.

A fifth embodiment of the window covering structure 100 shown in FIG. 9, is substantially identical to the first preferred embodiment described above except that alternative first and second sheets of material 114 and 116 are used that have extensions 120 which may be folds in the continuous sheet of material that extend outward from one side only of each sheet. The extensions 120 overlappingly affixed to the slat tabs 58 and 60 are the connecting portions of this embodiment. The first sheet of material 114 and second sheet of material 116 are oriented relative to one another such that each extension 120 of first material 114 is directed toward a corresponding extension 120 of second material 116. Each corresponding set of extensions 120 of first material and second material are connected by the elongated slat 56. A secondary slat 55 rests on each elongated slat 56.

Figure 9A:
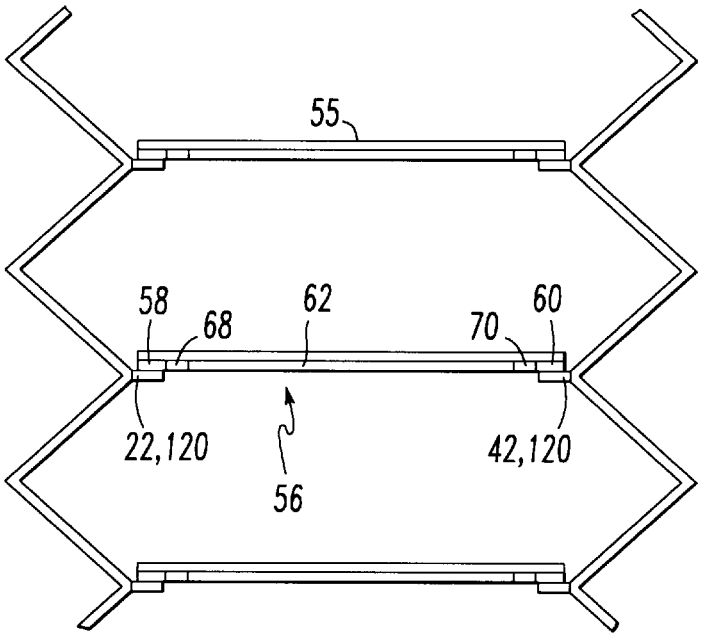
FIG. 9A is a side elevation view of a portion of an alternative preferred embodiment of the window covering structure.
Figure 10:
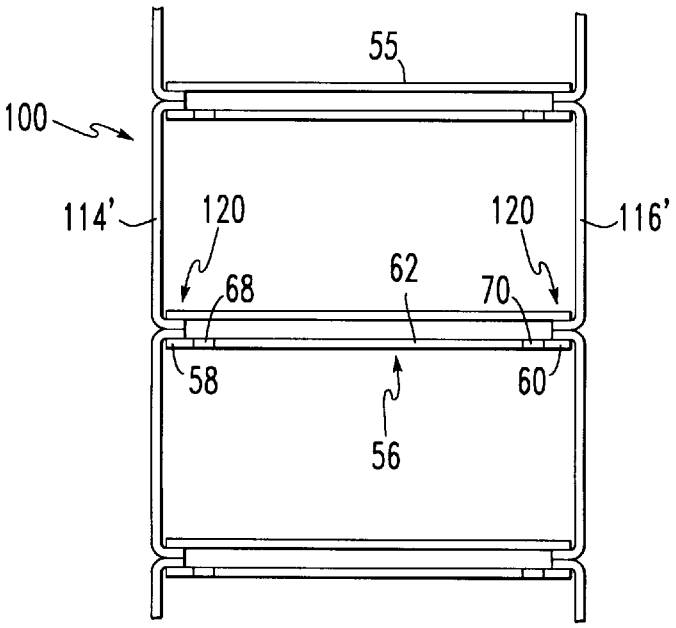
FIG. 10 is a side elevation view of a portion of a sixth preferred embodiment of the window covering structure.

In a sixth preferred embodiment, the extensions 120 may be alternatively formed by splicing together pieces of material 114' and 116' as shown in FIG. 10. Alternatively, separate segments of material may be the extensions by being adhered to a sheet of material as shown in FIG. 9A. Also, one sheet of material may have pleats directed in opposite directions and the other may have either no pleats or pleats directed in only one direction. Holes for lift cords to pass therethrough may be placed in any combination of the first and second slat tabs and the extensions. The operation of this embodiment is substantially identical to the operation of the first preferred embodiment, except that when the structure is placed in a stacked position, the first and second sheets of material do not collapse about preformed creases but rather fold about soft creases that form naturally upon the collapsing material.

Figure 11:
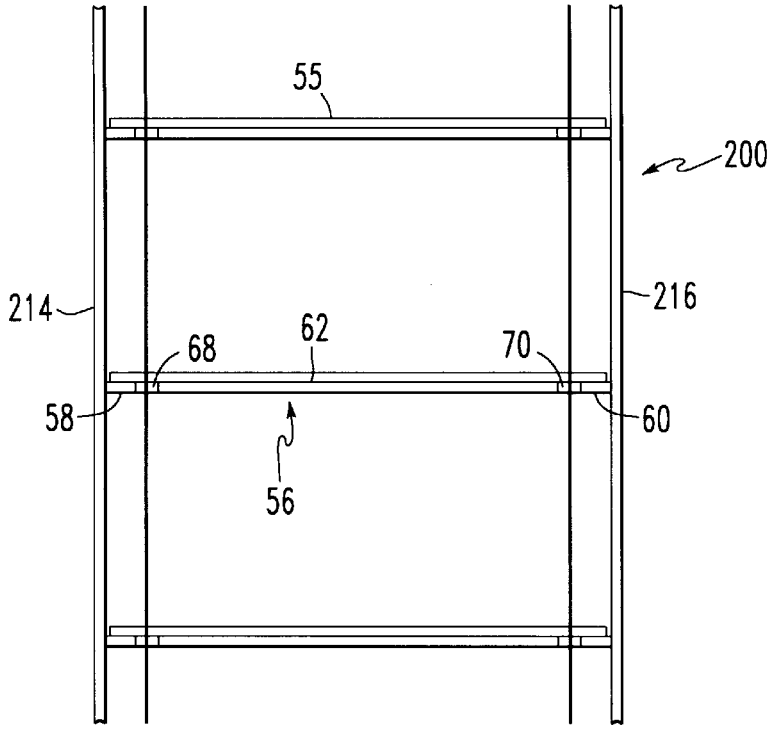
FIG. 11 is a side elevation view of a portion of a seventh preferred window covering structure.

The window covering structure 200, shown in FIG. 11, is substantially identical to the first and second preferred embodiments except that straight, unpleated sheets of first and second material 214 and 216 and having no extensions are used. The hinged elongated slats 56 are abuttingly affixed at each end of the slat to the first sheet of material 214 and second sheet of material 216. The operation of this embodiment is substantially identical to the operation of the preferred embodiment except that when the structure is placed in a closed position, the first and second sheets of material collapse and fold about soft creases formed naturally in the material upon collapsing of the material.

Figure 13:
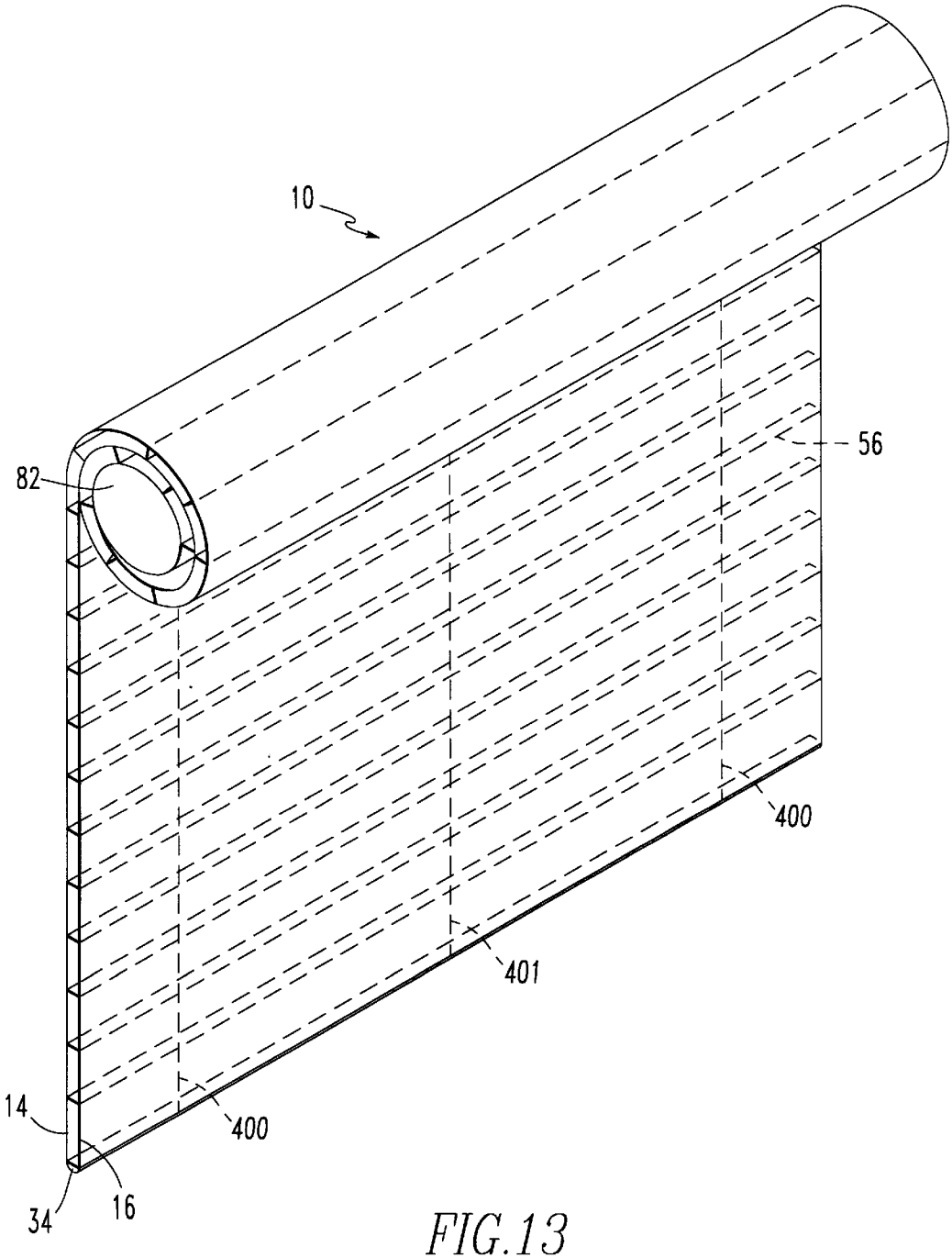
FIG. 13 is a perspective view of a ninth preferred embodiment having a roller for raising and lowering the preferred window covering structure.
Figure 14:
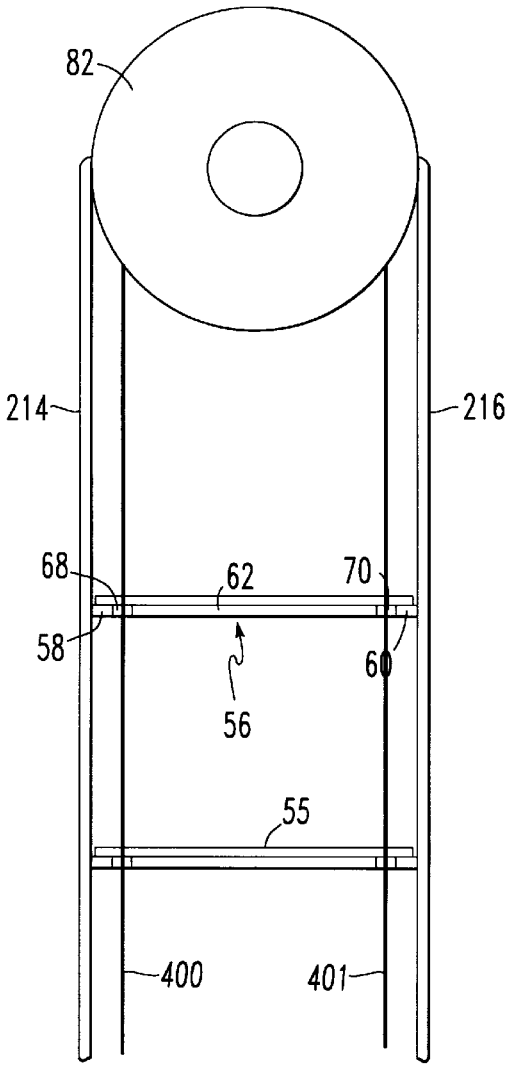
FIG. 14 is a side elevation view of a portion of the ninth preferred embodiment in an open position.
Figure 15:
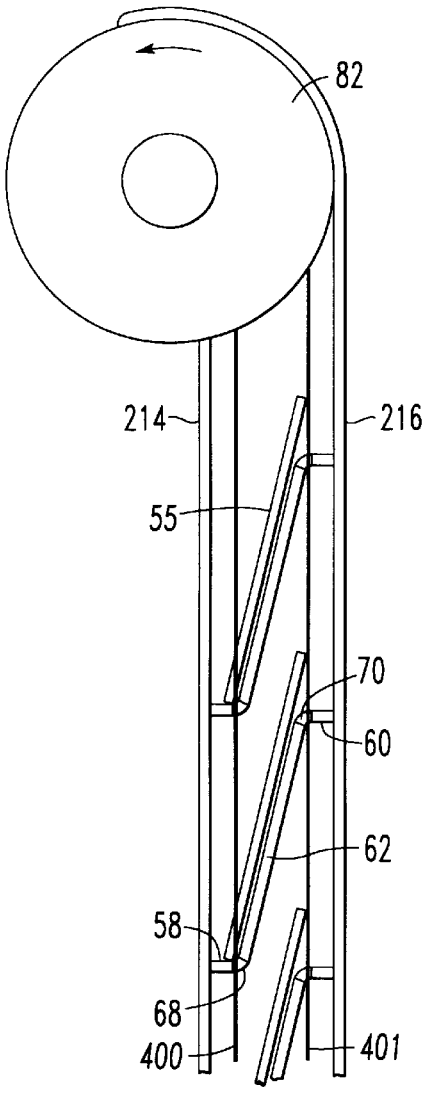
FIG. 15 is a side elevation view of a portion of the ninth preferred embodiment in a closed position.

The multi-layer fabric could be rolled on a roller as shown in FIGS. 13, 14 and 15. In this embodiment only a single cord 400 is needed if the slats are to be tilted in only one direction. The cord would be place behind the inside surface of first sheet 214 passing through the slat tab 58 or the slat hinge 68. The cord connected to the roller at point 61 runs parallel to the surface of first sheet 214 and is connected to a bottomrail. The secondary slat 55 has a notch or slot that corresponds to the position of the cord. The cord is maintained in tension because it is a constant length and is held by the weight of the bottomrail. It is preferred to have a high friction fit where the cord passes through the elongated slat 56. An additional cord 401 can be provided along the inside surface of the second sheet if the roller can be tilted in both directions. This cord need not be in the same transverse plane as the first cord as shown in FIG. 13.

Figure 12:
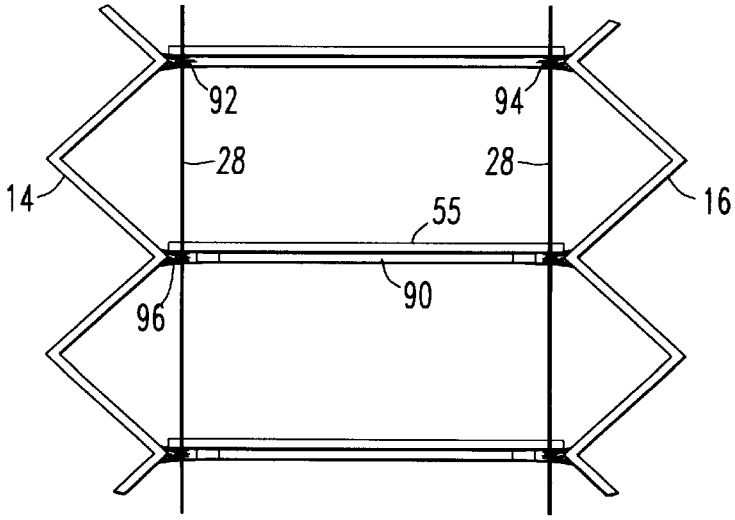
FIG. 12 is a side elevation view showing an alternative slat used in a portion of an eighth preferred embodiment of the window covering structure.

In any of the above-described preferred shade embodiments, an alternative elongated slat 90, shown in FIG. 12, may be used. The alternative elongated slat 90 is a relatively thin, flat, unhinged member. A first end 92 of the elongated slat 90 is affixed to one side of the sheet of first material and a second end 94 of the slat 90 is affixed to the opposite side of the sheet of second material. The connecting portions that flexibly affix elongated slats 90 to the first and second sheets of material are a plurality of flexible strands 96. The strands 96 allow the elongated slats 90 to move relative to the first and second sheets of material into a closed and open position in the identical manner as described in the preferred embodiments. Therefore, strands 96 also act as hinges. The region in which the strands 96 are placed is preferably wide enough such that at least one lift cord 28 may be disposed through corresponding spaces between the strands 96. The cord also passes through the slots in the secondary slats 55. The strands 96 may be applied through a heated reservoir so that the strands 96 are applied in a liquid state. The adhesive utilized for the strands 96 is selected to solidify after contact with ambient air. The liquid adhesive will adhere to a surface it contacts. Thus, the strands 96 are placed upon and travel back and forth between the end of the elongated slat 56 and the sheet of material, adhering to each. As a result, a plurality of strands 96 of flexible adhesive connect the elongated slat 56 to the sheet of material much like a spider web. Any suitable material may be used as the flexible adhesive such as a polyester or a polyurethane. A second slat 55 is placed on each elongated slat.

With respect to the above-described embodiments, it is evident that it is often desirable to adhere two sections of material to one another. Traditionally, beads of adhesive are applied between the sections of material to affix them. When a movable connection is desired between two sections of material, such as with the embodiments described above, one may connect the two sections of material with a connecting section or slat which is either glued, welded or sewn at opposed ends to the two sections of material. As an alternative to using elongated slats that are hinged and that have connecting portions, a simple rigid slat may be used if it is connected at each side by a plurality of strands 96. Thus, the strands 96 serve as both the connecting portions and the hinges. Also, other uses of material, such as clothing, require sections of material to be connected to one another. The plurality of strands 96 described above may be utilized in each of these applications.

Figure 16A:
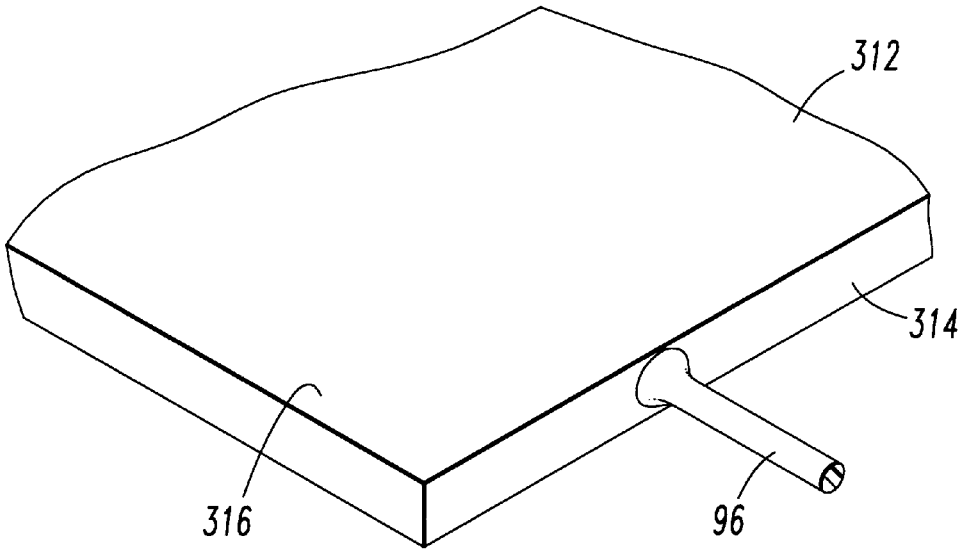
FIG. 16A is a perspective view of a portion of a flat sheet of material showing a strand connected to a transverse edge thereof.
Figure 16B:
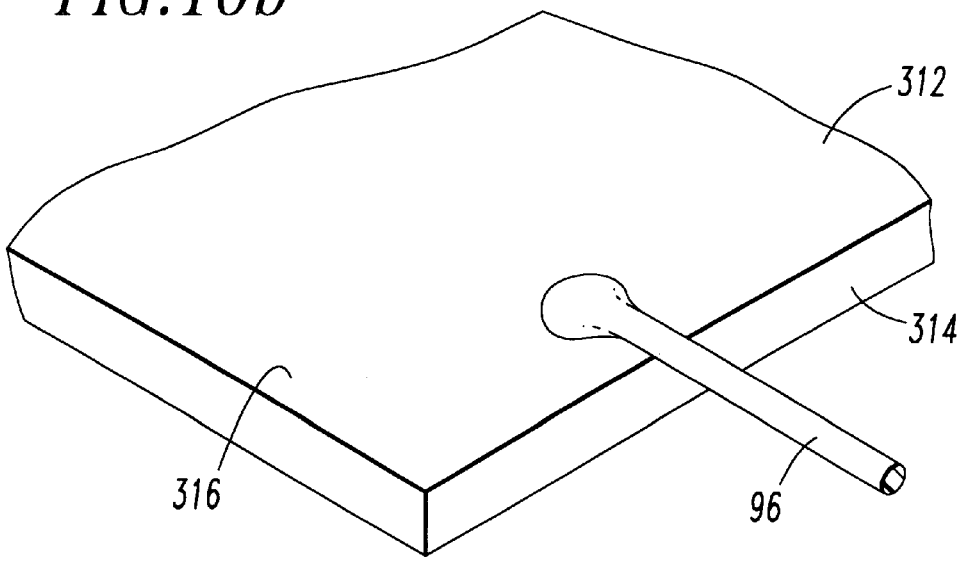
FIG. 16B is a perspective view of a portion of a flat sheet showing a strand connected to a flat face surface thereof.

Referring to FIGS. 16A and 16B, a relatively flat sheet of material 312 is shown having a transverse edge 314. A strand 96 is shown that is connected to said transverse 314 of the sheet of material. As can be seen in FIG. 16B, the strand 96 need not be attached along the transverse edge 314 of the flat sheet 312 but may instead be attached to a face surface 316 at some selected distance back from the transverse edge 314. In either FIGS. 16A or 16B, a plurality of strands 96 may be so provided. The plurality of strands 96 may be positioned as desired to connect the material sections, however, it is preferred that the strands 96 extend across in a direction parallel with one of the sides of material. Thus, when two sections of material are provided side by side, it is preferred that the strands, which are each perpendicular to the sections of material, extend as a group along the sections of material in a transverse direction.

Figure 17A:
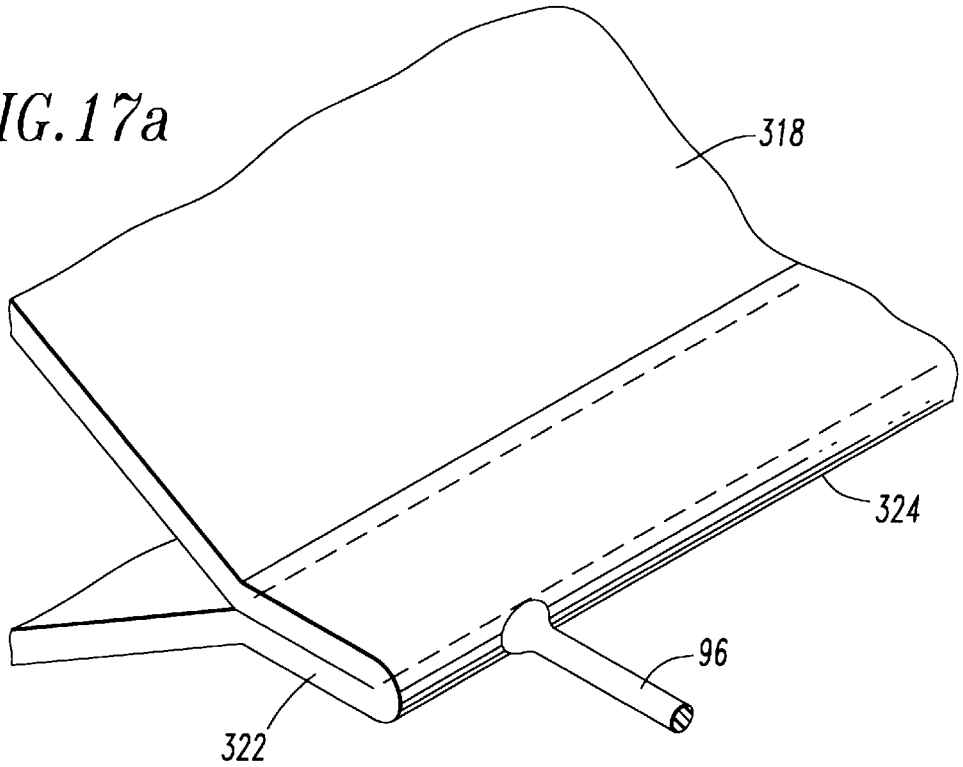
FIG. 17A is a perspective view of a portion of a tabbed pleated panel showing a strand attached to the transverse edge thereof.
Figure 17B:
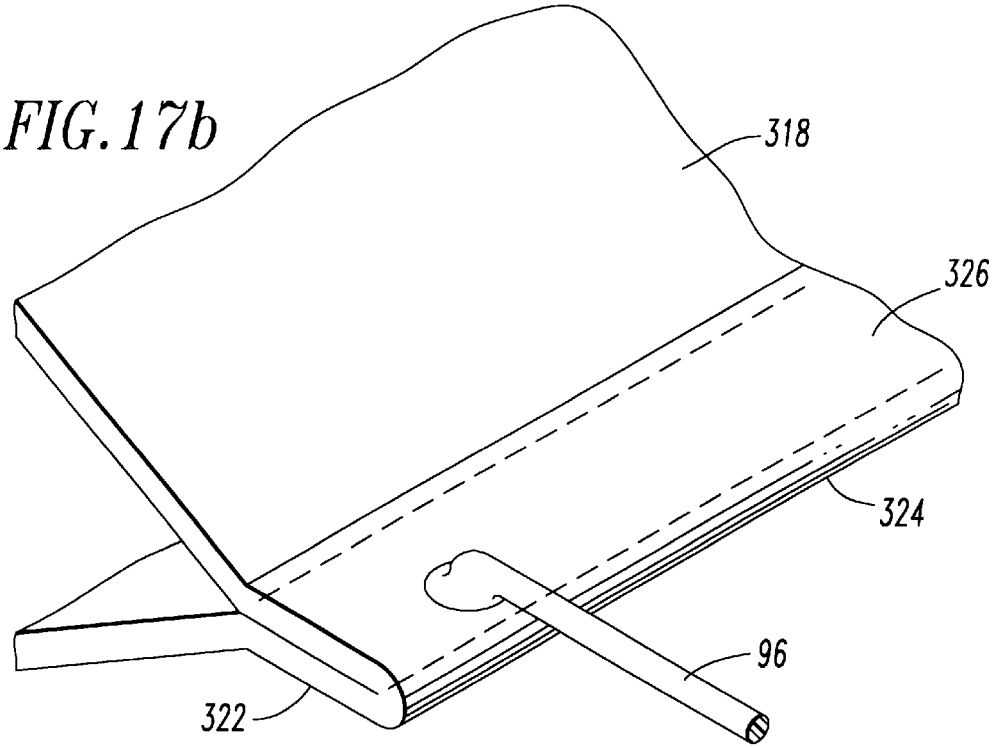
FIG. 17B is a perspective view of a portion of a tabbed pleated panel showing a strand attached to a face surface thereof.

The strands 96 may be attached to pleated material, or to any size or configured material, such as can be seen in FIGS. 17A, 17B and 17C. Referring first to FIG. 17A, a portion of a pleat 318 of a pleated panel of material is shown having a tab 322 formed thereon. Pleat 318 has a transverse edge 324 at tab 322 upon which the strand 96 is connected. As can be seen in FIG. 17B, the strand 96 need not be connected to the transverse edge 324 of the pleat 318 but rather may be attached to a face surface of the pleat such as along the top side 326 of the pleat at some selected distance back from the transverse edge 324. Also, a portion of a pleat 318 of a pleated panel of material is shown in FIG. 17C which is untabbed. In this alternative, the strand 96 may be attached to the transverse edge 324 of the pleat 318. Also, it is understood that the strands 96 may be attached to a face surface of the pleat at some selected distance back from the transverse pleat crease 324.

The strands 96 may be formed and connected to opposed sections of material by any convenient means. A preferred means will be described with reference to FIGS. 18A–18C. Referring first to FIGS. 18A and 19, a curable liquid is dispensed from a movable applicator 328. The applicator 328 consists of a holding area or well 330 within which the curable liquid is held. The well 330 is provided with an opening 332 at the bottom thereof through which the liquid may be dispensed. The well opening 332 is preferably disposed on the bottom of well 330 so that gravity will assist in causing the curable liquid to exit well opening 332 or, at the least, will not hinder the liquid from exiting the opening 332. A post 334 is preferably provided through and extends outward from well opening 332. The post 334 is sized and configured such that when it is placed through well opening 332, a space 336 extends around post 334. It is preferred that well opening 332 is circular and that post 334 is generally cylindrical or conical so that post 334 has a circular cross section. In this way, space 336 will be generally annular and the liquid may flow generally evenly around post 334.

The applicator 328 is positioned in FIG. 18A such that the liquid which is clinging to the sides of the post 334 moves adjacent a front section of material 338. The sections of material in FIGS. 18A–18C upon which the strands 96 are bonded are shown as being pleated or creased sections of material. However, it is understood that any shape of material sections may be so bonded, including pleated and tabbed material or flat sections of material. The curable liquid contacts the front section of material 338, preferably at a transverse edge of the front section of material 338, bonding the adhesive to the front section of material 338.

Next, as can be seen in FIG. 18B, the applicator 328 is moved away from the front section of material 338. The liquid is delivered out of well 330 by any convenient means, including pressure extrusion, however, the preferred means is by capillary action as the liquid is connected to a surface and is drawn away from that surface. Also, the liquid may be delivered from well 330 by the force of gravity, or by gravity in combination with capillary action. Capillary action moves the liquid from the well to the posts. It is cohesive strength (viscosity) and surface tension of the liquid that pulls the strand. When the liquid cures or solidifies, the cohesive strength (viscosity) increases. Very small cross sections of the strand involved make a greater variety of strand materials possible.

The applicator 328 moves away from the front section of material 338 while liquid continues to flow out of well 330 and along the sides of post 334. The effect is that a strand 96 is drawn from the contact point on the front section of material 338 to the post 334 of applicator 328. As the liquid is being drawn into a strand, it is being solidified or cured through contact with the ambient air. The air may be cooled or contain catalysts.

Next, as can be seen in FIG. 18C, the applicator 328 is moved so that the liquid on post 334 contacts a rear section of material 340, preferably at transverse edge of rear section of material 340, such that the strand 96 now runs from the front section of material 338 to the rear section of material 340. At this point, the applicator 328 may return at a slight angle to the front section of material 338 to a point along the transverse edge of the front section of material 338 a short distance from its previous bonding point, and then run a subsequent strand 96 towards the rear section of material 340 and the process is repeated. In this way, a zig-zag pattern of strands 96 will eventually be formed, which extend along a transverse direction of the sections of material 338, 340 connecting the two sections of material 338, 340 as is shown in FIG. 20B.

Figure 20A:
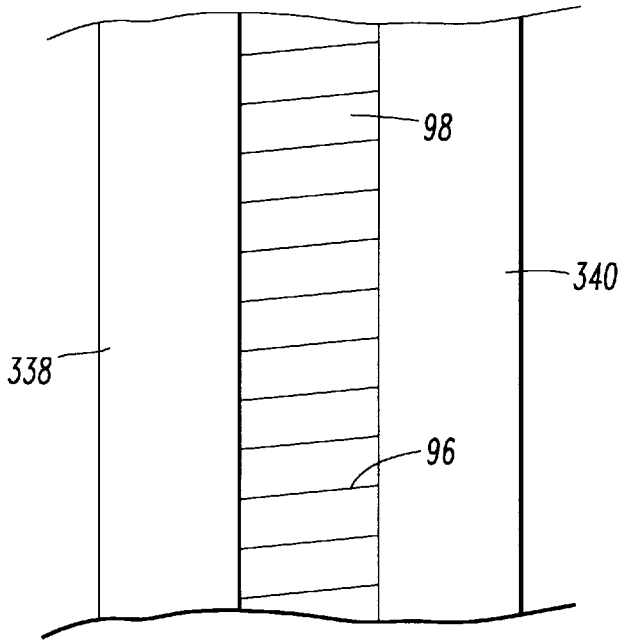
FIG. 20A is a top plan view of two sections of material connected by a generally parallel plurality of strands.
Figure 20B:
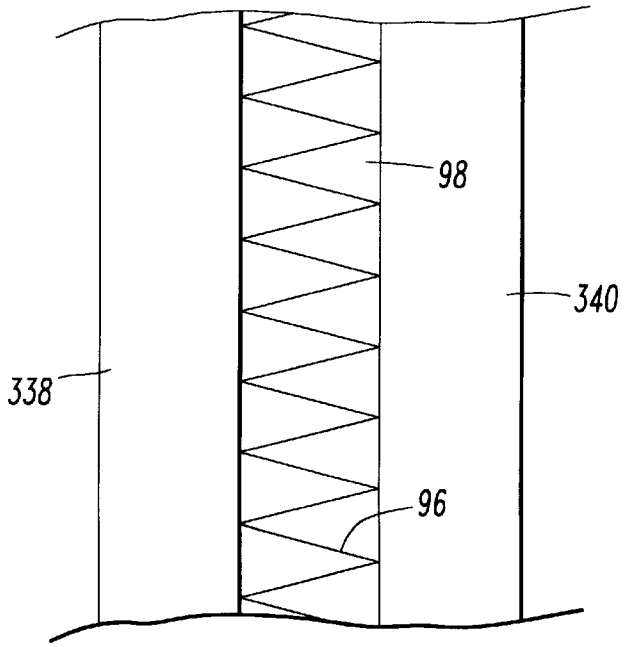
FIG. 20B is a top plan view of two sections of material connected by a plurality of strands in a zig zag pattern.

As an alternative, once a strand 96 is run to the rear section of material, the applicator 328 may index a selected distance along the transverse edge of the rear section of material 340 and then proceed back towards the front section of material 338 and repeat the process so as to form a plurality of generally parallel strands 96, such as is shown in FIG. 20A.

Any number of strands may be provided to connect two sections of material. Furthermore, the strands may be at any selected distance apart. The number of strands per inch depends upon a number of considerations, such as production time (the more strands that are used, the longer the structure will take to manufacture), the appearance of the final product (fewer strands look weaker), and strength (the greater the number of strands, the stronger will be the bond between the two sections of material). Between each two adjacent strands is a space 98. Even if the strands 96 are formed immediately next to one another, the strands 96 are flexible so that two adjacent strands 96 may be moved away from one another so that a space may be provided between the two such as for the placement of a lift cord of a window shade assembly.

The strands may be formed of any suitable material which can be applied in a generally liquid form, strung in a strand and which can be cured, preferably through contact with ambient environment, to a solid flexible strand. Suitable materials include polyester based adhesives such as the type which may be cured through cooling. In the case of a polyester curable by cooling, the well 330 of the applicator 328 may contain a heating unit or the liquid should be otherwise heated in the applicator so as to be in a liquid state. Thus, when the liquid is no longer in immediate contact with the applicator 328 and the post 334, contact with the ambient temperature air or material causes the liquid to begin to cure into a solid strand 96.

Other suitable materials to be used as the strand material include polyurethane such as the type which is cured through contact with moisture. In this case, the well 330 of the applicator 328 should maintain a relatively moisture free environment so that the strand material is in a relatively liquid state and may flow freely out of the well 330 along post 334 and be strung into a strand 96. Contact with the ambient air will cool and solidify the strand and contact with the moisture in the air over time would cause the polyurethane to cure and cross-link for additional strength.

With the above mentioned materials as well as others, the viscosity of the liquid may be controlled so that when considered in cooperation with the size of the annular space 336 around post 334, a flow rate of adhesive out of well 330 may be obtained. For example, in the case of polyester cured by cooling, the higher the temperature maintained in the well 330, the less viscous is the adhesive within the well 330 and the more freely the adhesive will flow out of well 330. The speed at which the applicator 328 travels between sections of material, stringing a strand 96, may also be varied so as to obtain a proper speed for producing the strand 96 at the selected viscosity of the liquid strand material.

The thickness of each strand 96 may be selectable based upon the material chosen, the viscosity of the liquid in the well, and the rate of travel of the applicator 328 between the sections of material. Furthermore, each strand 96 may be as long or short as is desired.

Figure 21:
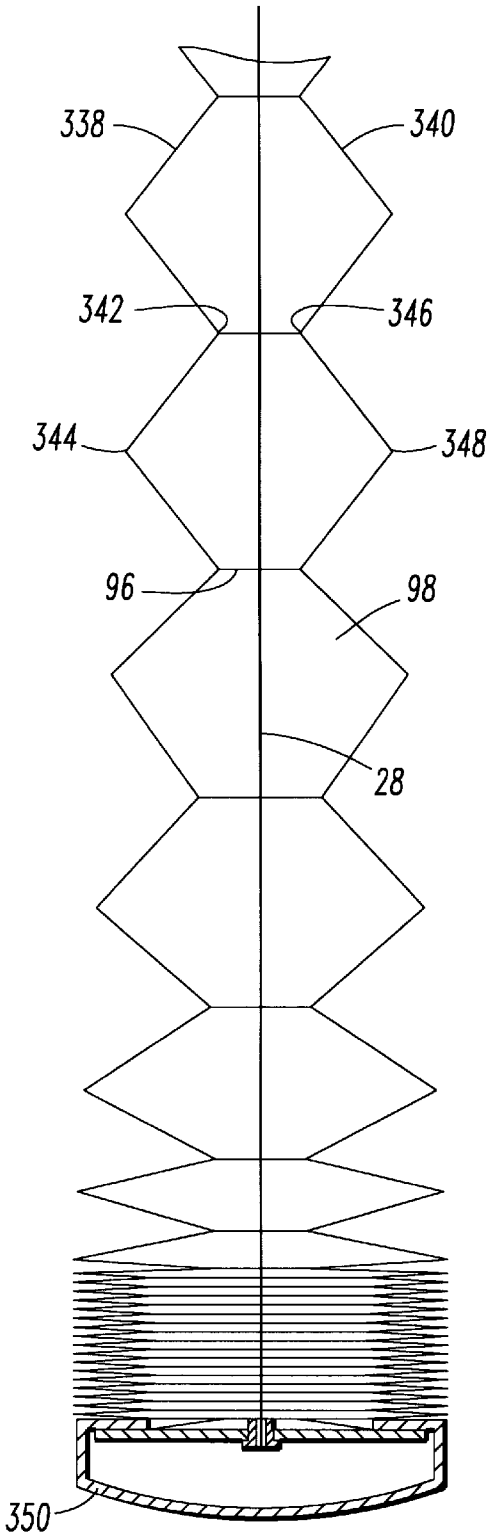
FIG. 21 is a side elevational view of a first preferred window cover structure utilizing strand connections.

FIG. 21 is a side elevational view of a first preferred window cover structure which utilizes a plurality of strands 96 as connections of two sections of material. The window covering structure has a front sheet of material 338 and a rear sheet of material 340 which are spaced apart from one another. Both the front sheet 338 and the rear sheet 340 are pleated so as to have a plurality of transverse folds or pleats lying thereupon. The pleats are alternatingly directed in opposite directions to one another such that one side of the front sheet 338 has a series of inwardly directed pleats 342 provided thereon. The opposite side of the front sheet 338 has a series of outwardly directly pleats 344 provided thereon. Similarly, one side of the rear sheet 340 has a series of inwardly directed pleats 346 provided thereon. The opposite side of the rear sheet 340 also has a series of outwardly directly pleats 348 provided thereon. The inward pleats 342, 346 of the front and rear sections of material 338, 340 may have tabs provided thereon (not shown). Furthermore, the outward pleats 344, 348 of the front and rear sheets 338, 340 may also have tabs provided thereon (not shown). Although front sheet 338 and rear sheet 340 are shown as being pleated shades, they may be non-pleated shades so as to form a roman shade type window cover structure.

In the embodiment shown in FIG. 21, the front sheet 338 and rear sheet 340 are oriented relative to one another such that each front sheet inward pleat 342 is directed towards a corresponding rear sheet inward pleat 346. Each corresponding set of inward pleats 342, 346 are connected by a plurality of strands 96. Preferably, the strands 96 connect to each of the inward pleats 342, 346 along the transverse edge of each pleat. However, the strands may be provided at a selected distance on each inward pleat from the transverse edge of each pleat. With each corresponding set of inward pleats 342, 346, thus connected by a respective plurality of strands 96, a generally honeycomb structure is formed. As can be seen in FIG. 21, a lift cord 28 may then be disposed through the spaces 98 between adjacent strands 96 connecting each set of inward pleats and be connected to a bottomrail 34. It is understood that although the embodiment of FIG. 21 is described in terms of sheets 338, 340 being pleated, sheets 338, 340 may be each unpleated or pleated and tabbed or combinations thereof.

Figure 22:
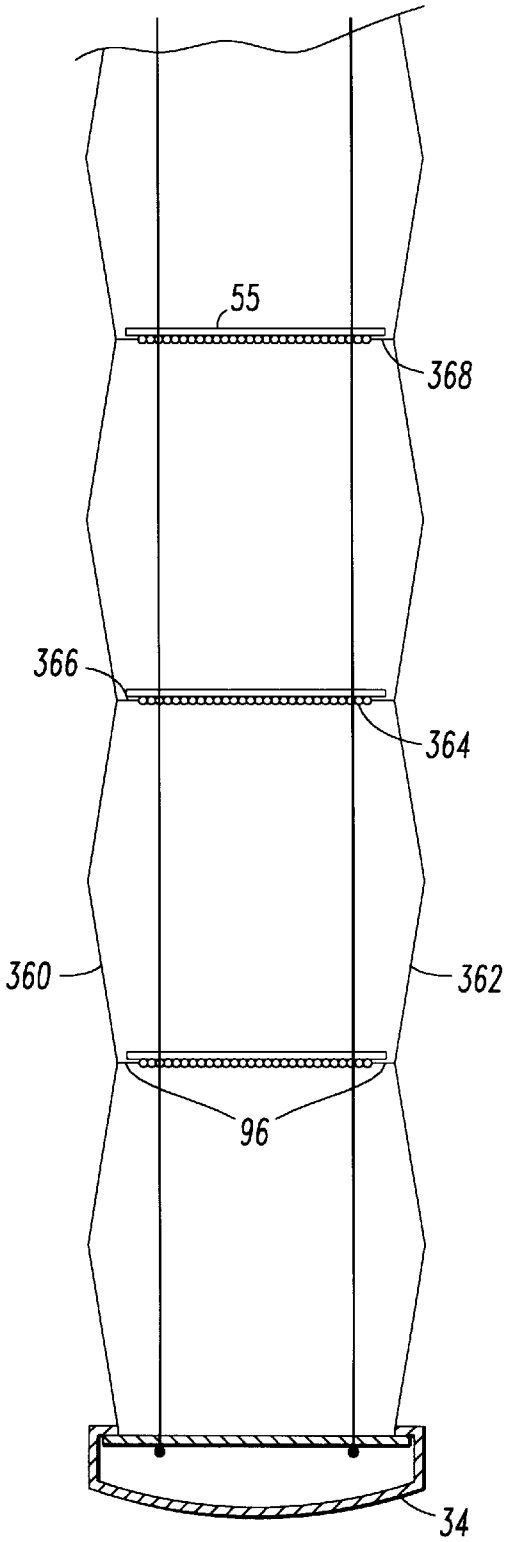
FIG. 22 is a side elevational view of a second preferred window cover structure utilizing strand connections.

Referring next to FIG. 22, a second preferred window cover structure utilizing a plurality of strands 96 that connect material sections is shown. The embodiment shown in FIG. 22 has a front sheet 360 and a rear sheet 362 spaced apart from one another. Front and rear sheets 360, 362 may each be tabbed or untabbed pleated shades or may be non-pleated sheets. Provided between the front sheet 360 and the rear sheet 362 are a plurality of connecting segments 364. The connecting segments 364 are spaced apart and are oriented generally perpendicular to the front sheet 360 and rear sheet 362 when the front and rear sheets 360, 362 are fully extended. The connecting segments 364 are connected to the front sheet 360 and rear sheet 362, respectively, by separate groups of strands 96. Thus, a first group 366 of strands 96 connects each connecting segment 364 to the front sheet 360. Likewise, a second group 368 of strands 96 connects each connecting segment 364 to the rear sheet 362. Lift cords run through the slots 59 in the secondary slats 55 and then may be run through one or both or neither of the groups 364, 366 of strands 96. The plurality of strands in the first and second groups of strands 366, 368 each extend in a transverse direction along the front sheet 360 and the rear sheet 362. The connecting segments 364 may be either rigid or flexible. In fact, a sheer fabric may be used as the connecting segments 364, or for the front or rear sheets or both.

Figure 23:
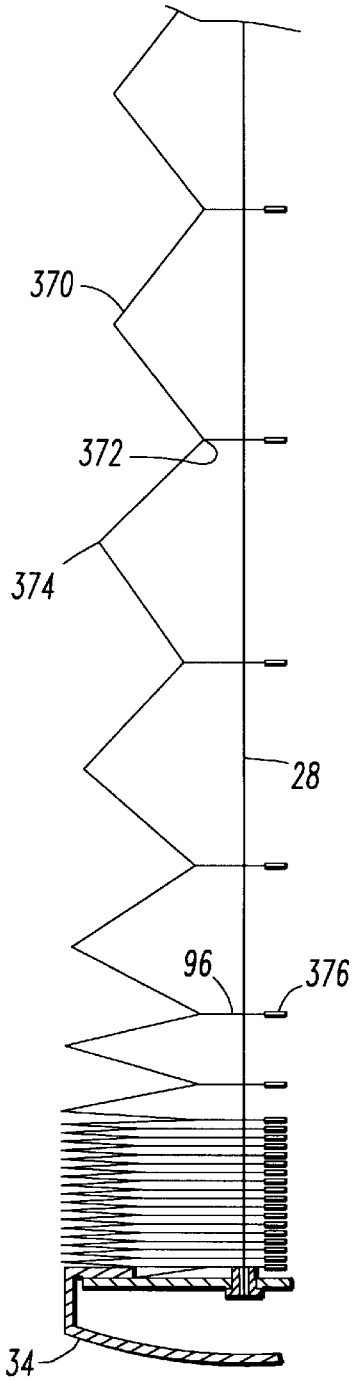
FIG. 23 is a side elevational view of a third preferred window cover structure utilizing strand connections.

Referring next to FIG. 23, a third preferred embodiment of a window cover structure utilizing a plurality of strands is shown. An elongated sheet of material 370 is provided. Sheet 370 is preferably pleated so as to have a plurality of transverse folds or pleats lying thereon. The pleats are alternatingly directed in opposite directions to one another such that one side of the sheet 360 has a series of inwardly directed pleats 372 disposed thereon. The opposite side of the sheet 370 has a series of outwardly directly pleats 374 directed thereon. Inward pleats 372 have tabs formed thereon. Similarly, outward pleats 374 may have tabs thereon. Alternatively, sheet 370 may be a non-pleated panel of material. A plurality of ribbons 376 are provided and are spacedly arranged so that each ribbon 376 faces a respective inward pleat 372 of the sheet 370. Ribbons 376 extend along the transverse direction relative to the sheet 370 and are preferably of generally the same transverse width as are each inward pleat 372. A plurality of strands 96 connect each respective ribbon 376 to an inward pleat 372. The plurality of strands 96 extend transversely between each ribbon 376 and inward pleat 372. As noted above, spaces 98 (not shown) are provided between each two adjacent strands 96. A lift cord 28 may then be disposed through each grouping of strands 96 and be connected to a bottomrail 34.

Figure 25:
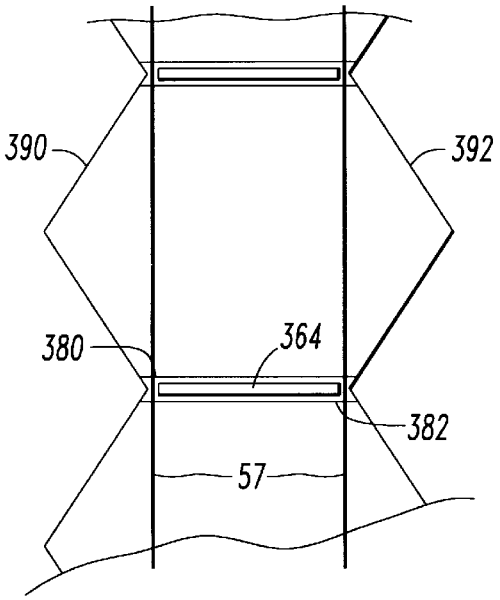
FIG. 25 is a side elevational view of a fourth preferred window cover structure utilizing strand connections.

In FIG. 25, a fourth preferred embodiment of a window cover structures utilizing a plurality of strands is shown. The embodiment shown in FIG. 25 has a front sheet 390 and a rear sheet 392 spaced apart from one another. Front and rear sheets 390, 392 may each be tabbed or untabbed pleated sheets or may be nonpleated sheets. Connecting the two sheets of material 390, 392 at various locations are sets of strands 380, 382. Provided between each respective first set of strands 380 and second set of strands 382 is a secondary slat 364. Thus, each secondary slat 364 is prevented from vertical movement by being contained within a respective first set of strands 380 and second set of strands 382. It is preferred that the secondary slats 364 are further prevented from side to side movement by having lift cords disposed through the slots in the secondary slats 364. As discussed with reference to the embodiments above, the secondary slats 364 may be either rigid or flexible. The plurality of strands in the first set of strands 380 and the second set of strands 382 each extend in a transverse direction along the front sheet 390 and the rear sheet 392.

Figure 26:
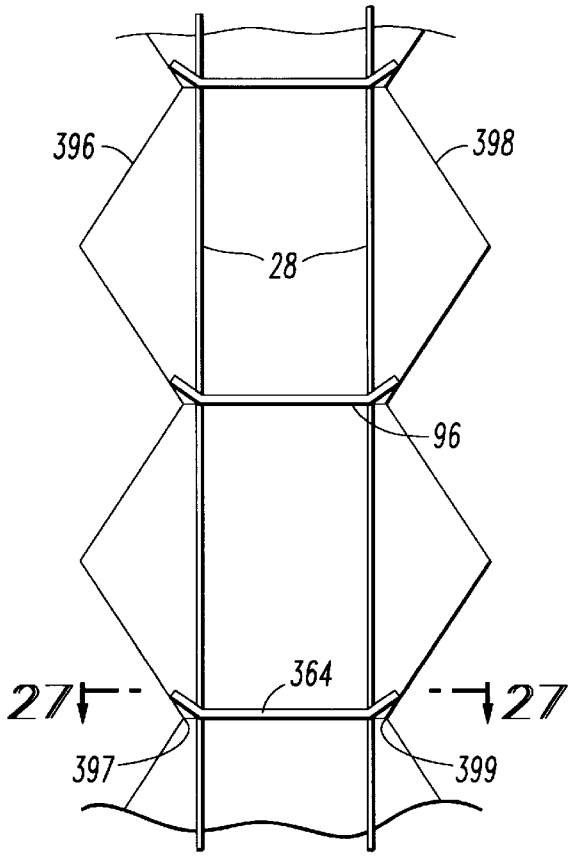
FIG. 26 is a side elevational view of a fifth preferred window cover structure utilizing strand connections.
Figure 27:
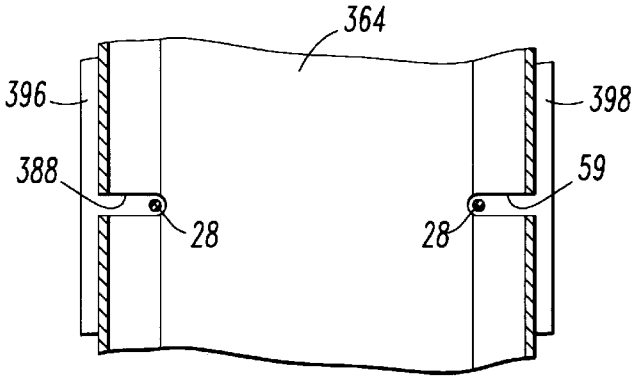
FIG. 27 is a view taken along line A—A of FIG. 26.
Figure 28:
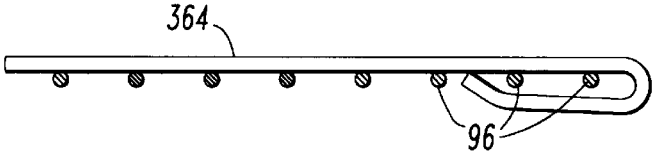
FIG. 28 is a front view of a portion of a connecting segment shown folded over the plurality of strands.

Referring next to FIG. 26, a fifth preferred embodiment of a window cover structure utilizing a plurality of strands is shown. This embodiment has a front sheet 396 and a rear sheet 398 spaced apart from one another. Sheets 396, 398 are preferably pleated so as to have a plurality of transverse folds or pleats lying thereon. The pleats are alternatingly directed in opposite directions to one another such that one side of sheet 396 has a series of inwardly directed pleats 397 disposed thereon. Similarly, rear sheet 398 has a series of inwardly directed pleats 399 disposed thereon. Confronting pairs of inward pleats 397, 399 are each connected by a plurality of strands 96. Furthermore, secondary slat 364 is also provided adjacent each set of strands 96. As can be seen best in FIG. 27, secondary slat 364 is preferably held in position by having slots 388 provided at opposed sides of connecting segment 364. Thus, lift cords 28 are disposed through slots 388 holding secondary slat 364 into position against the plurality of strands 96. The secondary slats 364 may be more narrow than those shown in FIG. 26. It is understood that front and rear sheets 396, 398 although shown as being pleated, may be tabbed and pleated or may be nonpleated sheets. Referring next to FIG. 28, secondary slats 364 may be longer in length than the width of the multi-layer assembly and therefore the strands 96. The secondary slats 364 can be folded over some of the strands 96 of the plurality of strands on each end of the secondary slat and be thus held into position against the plurality of strands 96 from lateral movement without utilizing the slots and cord combination. The secondary slats 55 in the previously described embodiments could be extended and similarly folded over one or both ends of the elongated slats on which they rest. Alternatively, the slats may be attached to one or more strands 96 and be more narrow than the width of the multi-layered assembly.

Figure 24:
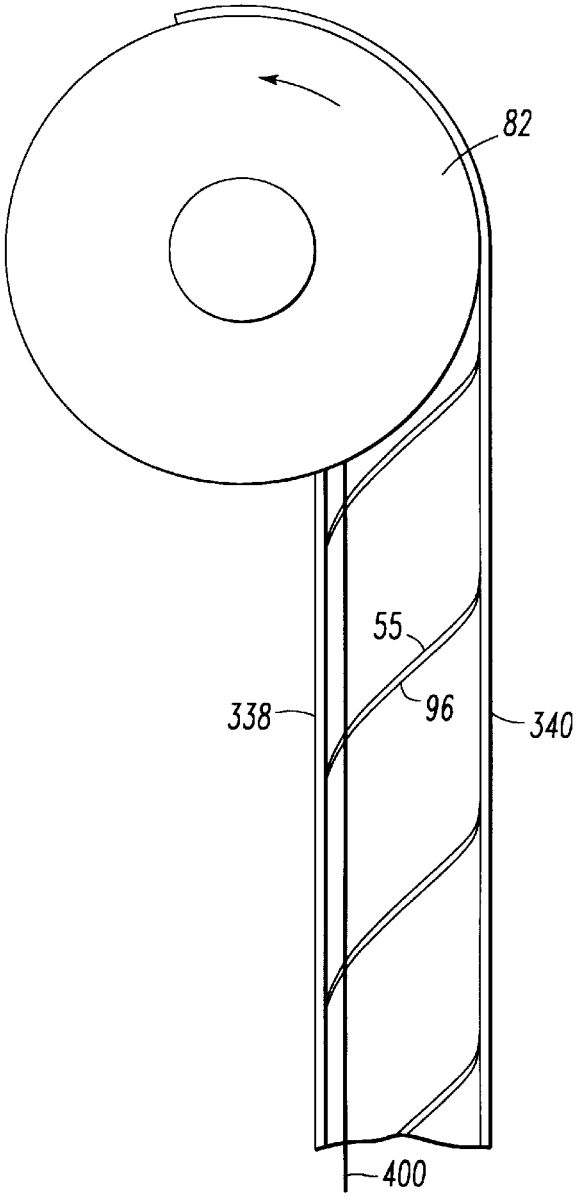
FIG. 24 is a side elevational view of a roller for raising and lowering the preferred window covering structures.

Variations of the preferred embodiments could be made. Any number of lift cords 28 may be employed to raise and lower the window covering structure. Furthermore, the window covering structures described above may be raised and lowered by other convenient means such as by winding or unwinding the structure about a roller 82, seen in FIG. 24. In addition to raising and lowering the window covering structure with roller 82, the roller 82 may also be used to open and close the structure. If the upper ends of the first material and second material are circumferentially affixed to the roller at a distance, then the roller may be oriented, as shown in FIG. 14, in the open position. However, if the roller 82 is then partially turned, as shown in FIG. 15, the relative positions of the first material and second material are shifted and the structure is moved in the closed position.

Although the figures for the tabbed embodiments show the elongated slats being connected to the pleat tabs along the bottom of each pleat tab, those slats could be connected along the top of each pleat tab. Additionally, the elongated slats could be connected to the bottom of the pleat tabs of the first material and to the top of the pleat tabs of the second material, or along the top of pleat tabs of the first material and to the bottom of the pleat tabs of the second material. In the latter two cases, if the pleat tabs were sufficiently rigid relative to the slats, the tabs could act as a fulcrum causing the slat to bend around the tabs when moved into the closed position. However, it is preferred that the elongated slats be attached on the edge of the slats by strands 96 and that the strands 96 act as the hinge members.

While certain present preferred embodiments have been shown and described, it is distinctly understood that the invention is not limited thereto but may be otherwise embodied within the scope of the following claims.

I claim:

1. A method of making a material structure, comprising the steps of:

(a) providing a front section of material and at least one second material spaced a selected distance from said front section of material;

(b) providing a curable liquid dispensably within an applicator;

(c) providing means for allowing said liquid adhesive to exit said applicator;

(d) positioning said applicator such that said liquid can be dispensed so as to form strands which contact and bond to said front section of material;

(e) moving said applicator away from said front section of material so as to form an elongated strand between said front section of material and said applicator;

(f) moving said applicator such that said strand contacts one of said at least one second material, and wherein said strand thereby connects said front section of material to said at least one second material; and (g) repeating steps (d) through (f) while indexing said applicator in a transverse direction such that any bonding point along said front section of material and said at least one second material is adjacent to a previous bonding point.

2. The method of claim 1 further comprising the step of, between steps (f) and (g), moving said applicator back towards said front section of material until said strand contacts said front section of material.

3. The method of claim 1 wherein said front section of material is a pleated panel having a series of inward transverse pleats provided on one side thereof.

4. The method of claim 3 wherein said at least one second material is a pleated panel having a series of inward transverse pleats provided on one side thereof, and wherein said inward pleats of said front pleated panel face the inward pleats of the rear pleated panel, and wherein confronting pairs of said inward pleats from said front pleated panel and said rear pleated panel are connected by said strands.

5. The method of claim 3 wherein said at least one second material is a plurality of elongated material segments oriented such that each material segment faces and is connected by said plurality of strands to a respective inward pleat of said front pleated panel.

6. The method of claim 5 wherein said material segments are relatively flexible.

7. The method of claim 5 wherein said material segments are relatively rigid.

8. The method of claim 7 further comprising the steps of:

(h) providing a rear pleated panel of material having a series of inward pleats disposed on one side thereof, said rear panel being positioned such that each inward pleat faces a respective material segment and is spacedly provided on a side of said material segment opposite to said inward pleats of said front pleated panel;

(i) positioning said applicator such that said liquid adhesive contacts and bonds to a selected inward pleat of said rear pleated panel;

(j) moving said applicator away from said rear pleated panel so as to form an elongated thread of adhesive between said inward pleat of said rear pleated panel and said applicator;

(k) moving said applicator such that said liquid adhesive contacts said material segment, and wherein said strand thereby connects said inward pleat of said rear pleated panel to said material segment; and (l) repeating steps (i) through (k), while indexing said applicator in a transverse direction such that any bonding point along said rear panel inward pleat and said material portion is adjacent to a previous bonding point.

9. The method of claim 8 further comprising the step of, between steps (k) and (l), moving said applicator back towards said inward pleat of said rear pleated panel until said liquid adhesive contacts said inward pleat of said rear pleated panel.

10. The method of claim 1 wherein said applicator is comprised of a well for containing said liquid adhesive, said well having an opening thereon, through which liquid adhesive may be dispensed.

11. The method of claim 10 wherein said well opening has a post suspended therethrough and extending outward therefrom, said post having sides and being sized and positioned so that a space is provided around said post through which liquid adhesive exits out therefrom and flows down along said sides of said post.

12. The method of claim 10 wherein said well opening is provided along a bottom location of said well.

* * * * *